US011198576B2

(12) United States Patent
Matsuo et al.

(10) Patent No.: US 11,198,576 B2
(45) Date of Patent: Dec. 14, 2021

(54) CONVEYANCE DEVICE AND PRINTING APPARATUS

(71) Applicant: CANON KABUSHIKI KAISHA, Tokyo (JP)

(72) Inventors: Kazuki Matsuo, Kawasaki (JP); Seiji Ogasawara, Machida (JP); Takaaki Ishida, Kawasaki (JP); Shuichi Tokuda, Kawasaki (JP); Masakazu Tsukuda, Yokohama (JP); Masaaki Matsuura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 16/270,950

(22) Filed: Feb. 8, 2019

(65) Prior Publication Data

US 2019/0248165 A1 Aug. 15, 2019

(30) Foreign Application Priority Data

Feb. 15, 2018 (JP) ..... JP2018-024638

(51) Int. Cl.
*B65H 7/18* (2006.01)
*B41J 15/04* (2006.01)
(Continued)

(52) U.S. Cl.
CPC ..... *B65H 7/18* (2013.01); *B41J 3/60* (2013.01); *B41J 11/0055* (2013.01);
(Continued)

(58) Field of Classification Search
CPC ..... B65H 3/0684; B65H 7/00; B65H 7/02; B65H 7/18; B65H 7/20; B65H 2511/11;
(Continued)

(56) References Cited

U.S. PATENT DOCUMENTS 4,709,915 A 12/1987 Ishikawa et al.
4,854,571 A 8/1989 Kitajima et al.
(Continued)

FOREIGN PATENT DOCUMENTS

JP 2007-161376 A 6/2007

OTHER PUBLICATIONS

U.S. Appl. No. 16/259,191, Shuichi Tokuda, Seiji Ogasawara, Takaaki Ishida, Masakazu Tsukuda, Masaaki Matsuura, Kazuki Matsuo, Tomofumi Nishida, Yuna Hattori, filed Jan. 28, 2019.

*Primary Examiner* — Prasad V Gokhale
(74) *Attorney, Agent, or Firm* — Venable LLP

(57) ABSTRACT

A technique that enables application of additional conveyance force to a print medium and conveyance of various sizes of print media without multi-feed is described. A conveyance device includes a feed unit, a first conveyance unit that conveys a print medium, and a second conveyance unit that conveys a print medium fed by the feed unit to the first conveyance unit, and is capable of correcting the skew of a print medium by causing the second conveyance unit to convey the print medium with its leading edge in abutment with the first conveyance unit. This conveyance device is configured to cause the feed unit to apply conveyance force to a print medium conveyed by the second conveyance unit, depending on the size of the print medium in the conveyance direction.

24 Claims, 15 Drawing Sheets

(51) Int. Cl.

| | |
|---|---|
| ***G03G 15/00*** | (2006.01) |
| ***B41J 13/00*** | (2006.01) |
| ***B41J 11/00*** | (2006.01) |
| ***B41J 3/60*** | (2006.01) |
| ***B65H 9/00*** | (2006.01) |

(52) U.S. Cl.
CPC ..... *B41J 13/0018* (2013.01); *B41J 13/0054* (2013.01); *B41J 15/046* (2013.01); *B65H 9/004* (2013.01); *G03G 15/00* (2013.01)

(58) Field of Classification Search
CPC ..... B65H 2511/12; B65H 9/00; B65H 9/004; B65H 9/006; G03G 15/6567; B41J 13/0018; B41J 13/0054; B41J 15/046
See application file for complete search history.

(56) References Cited

U.S. PATENT DOCUMENTS

| | | | | |
|---|---|---|---|---|
| 4,962,920 | A | 10/1990 | Kitajima et al. | |
| 4,974,828 | A | 12/1990 | Matsuo et al. | |
| 5,050,860 | A | 9/1991 | Matsuo et al. | |
| 6,273,414 | B1 | 8/2001 | Matsuo | |
| 8,672,439 | B2 | 3/2014 | Suzuki et al. | |
| 9,272,862 | B2 * | 3/2016 | Tateishi | B65H 3/0684 |
| 9,873,576 | B2 * | 1/2018 | Kondo | B65H 3/5253 |
| 10,324,410 | B2 * | 6/2019 | Mochizuki | G03G 15/6561 |
| 2015/0239687 | A1 * | 8/2015 | Shinkawa | B65H 7/14 271/171 |
| 2015/0256694 | A1 * | 9/2015 | Suzuki | B41J 13/0018 358/1.12 |
| 2015/0329301 | A1 * | 11/2015 | Mizuno | B65H 5/062 271/10.13 |
| 2017/0315494 | A1 * | 11/2017 | Mochizuki | G03G 15/6561 |
| 2019/0062093 | A1 * | 2/2019 | Inoue | B65H 5/38 |
| 2019/0184719 | A1 | 6/2019 | Matsuura et al. | |
| 2019/0193427 | A1 | 6/2019 | Tsukuda et al. | |
| 2019/0193432 | A1 | 6/2019 | Tsukuda et al. | |

* cited by examiner

| FIG.12A | FIG.12B |
|---|---|

CONVEYANCE DEVICE AND PRINTING APPARATUS

BACKGROUND OF THE INVENTION

Field of the Invention

The present invention relates to a conveyance device that conveys a sheet-shaped print medium and a printing apparatus including this conveyance device.

Description of the Related Art

In printing apparatuses that perform printing on a conveyed print medium, before a printing unit performs the printing process, a print-medium skew correction (registration) process is performed by overfeeding the fed print medium with its leading edge in abutment with a nip portion of a conveyance roller. Japanese Patent Laid-Open No. 2007-161376 discloses a technique in which additional conveyance force is applied to a print medium conveyed toward a nip portion in order to properly bring the leading edge of the print medium into abutment with the nip portion. Specifically, when the leading edge of the print medium reaches the nip portion, a pick-up roller out of contact with the print medium is brought into contact with it again, and a feed roller and the pick-up roller together overfeed the print medium.

However, in the technique disclosed in Japanese Patent Laid-Open No. 2007-161376, when the print medium size in the feed direction is small, there is a possibility that multi-feed of print media occurs because the next print medium following a print medium under skew correction is transferred by the pick-up roller.

SUMMARY OF THE INVENTION

The present invention has been made in view of the above problem, and an object thereof is to provide a conveyance device and a printing apparatus capable of applying additional conveyance force to a print medium and conveying various sizes of print media without multi-feed.

In a first aspect of the present invention, there is provided a conveyance device comprising:

a feed unit that feeds a print medium;

a first conveyance unit that forms a nip portion between a drive roller and a driven roller and is capable of conveying the print medium by pinching the print medium at the nip portion;

a second conveyance unit that conveys the print medium fed from the feed unit to the first conveyance unit, and corrects skew of the print medium by conveying the print medium with a leading edge thereof in abutment with the nip portion at the first conveyance unit, which is stopped; and a control unit that controls feed of the print medium by the feed unit, and controls the feed unit so as to control application of conveyance force from the feed unit to the print medium conveyed by the second conveyance unit in accordance with a size of the print medium in a conveyance direction.

In a second aspect of the present invention, there is provided a printing apparatus comprising:

a feed unit that feeds a print medium;

a first conveyance unit that forms a nip portion between a drive roller and a driven roller and is capable of conveying the print medium by pinching the print medium at the nip portion;

a second conveyance unit that conveys the print medium fed from the feed unit to the first conveyance unit, and corrects skew of the print medium by conveying the print medium with a leading edge thereof in abutment with the nip portion at the first conveyance unit, which is stopped;

a control unit that controls feed of the print medium by the feed unit, and controls the feed unit so as to control application of conveyance force from the feed unit to the print medium conveyed by the second conveyance unit in accordance with a size of the print medium in a conveyance direction; and a print head that performs printing on the print medium conveyed after skew of the print medium is corrected by the second conveyance unit.

According to the present invention, it is possible to apply additional conveyance force to a print medium and convey various sizes of print media without multi-feed.

Further features of the present invention will become apparent from the following description of exemplary embodiments with reference to the attached drawings.

DESCRIPTION OF THE EMBODIMENTS

Figure 1:
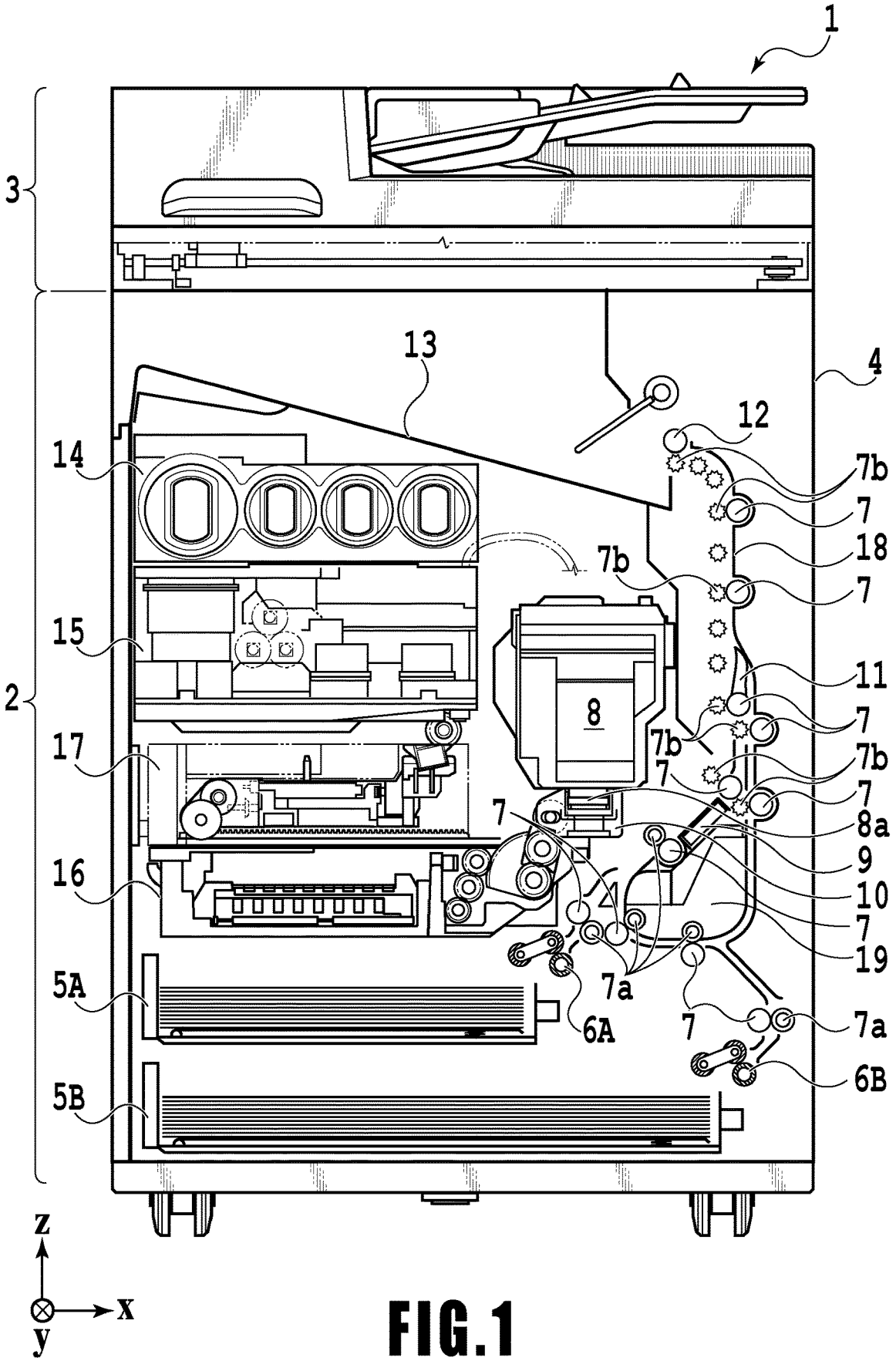
FIG. 1 is a view of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing media (cut sheets) S are detachably provided at the bottom of a casing 4 in the vertical direction. Relatively small printing media of up to A4 size are stacked and housed in the first cassette 5A and relatively large printing media of up to A3 size are stacked and housed in the second cassette 5B. A first feeding unit 6A for feeding housed printing media one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing media S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head 8 is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
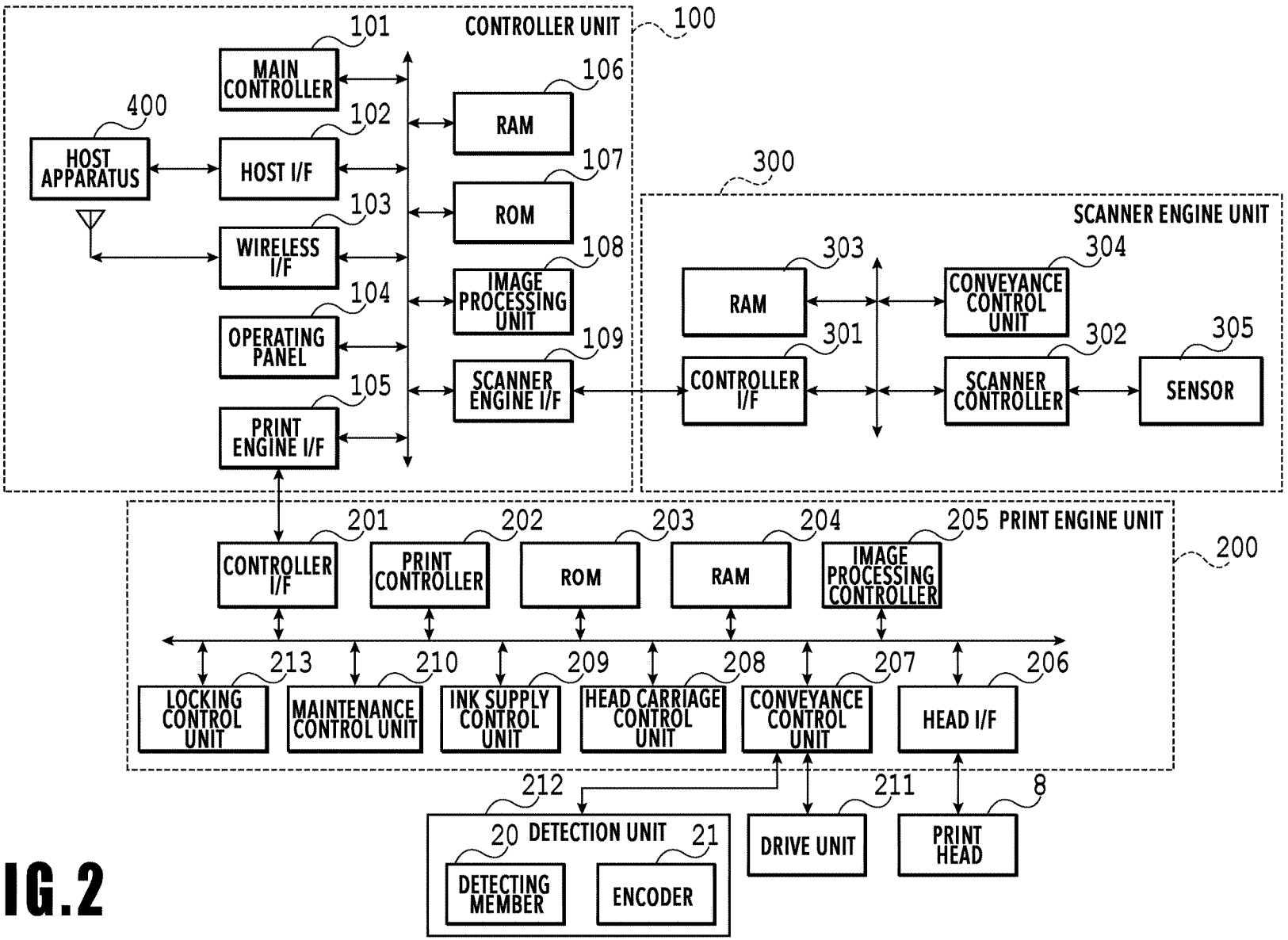
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to perform input and output for the printing apparatus 1. A user can input an instruction to perform an operation such as copying or scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

While a print medium S is conveyed by the conveyance control unit 207, a printing operation is performed by the print head 8 in accordance with instructions from the print controller 202 in combination with the operation of conveying the print medium S to thereby perform a printing process.

Ahead carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
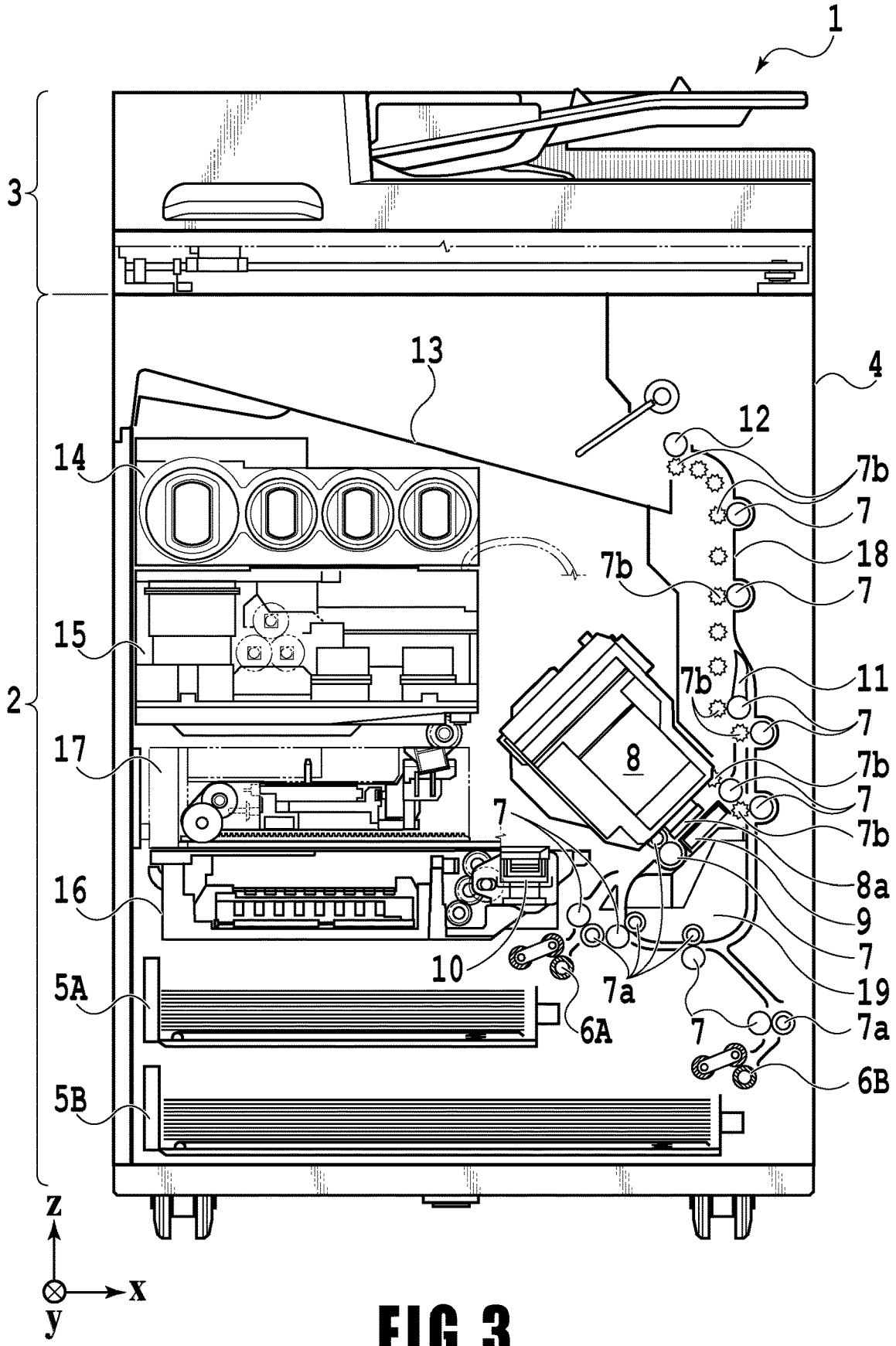
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
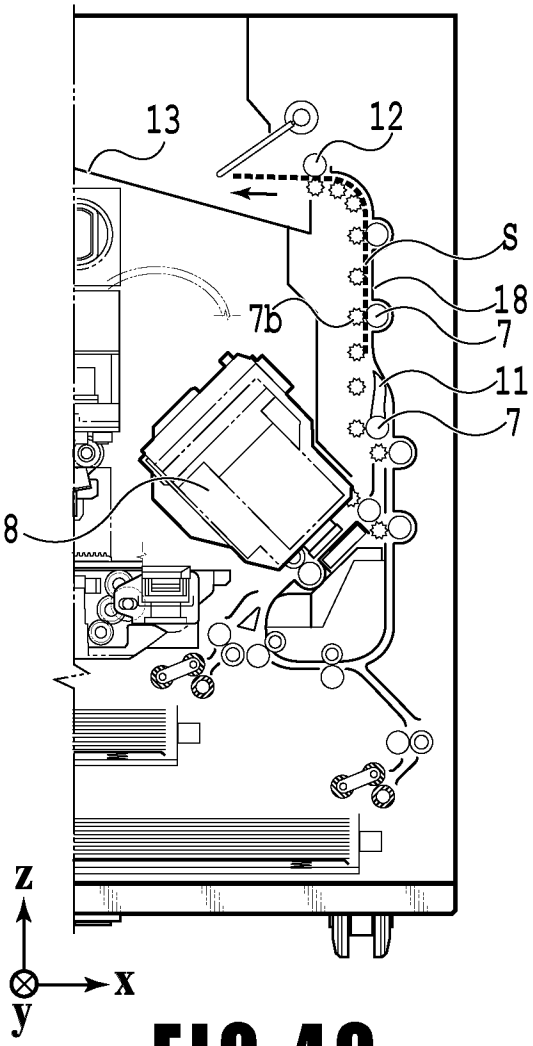
FIG. 4A, FIG. 4B, and FIG. 4C are views of a conveying path of a print medium fed from a first cassette.
Figure 4B:
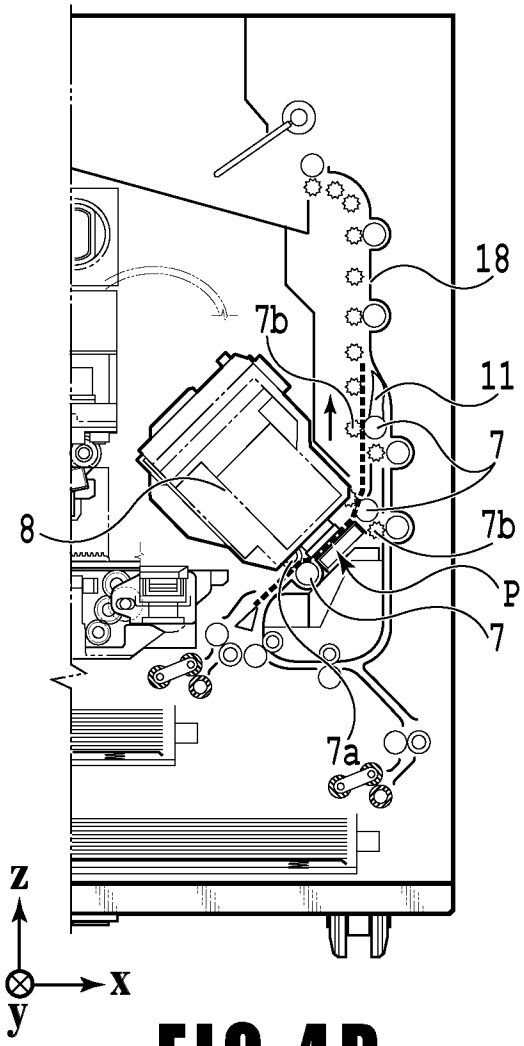
Figure 4A:
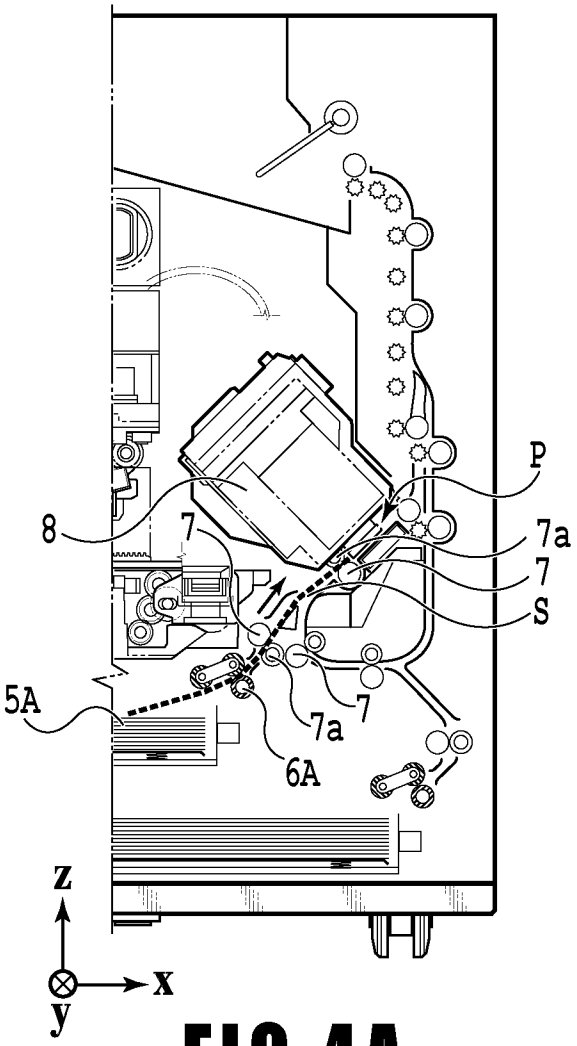

FIGS. 4A to 4C are diagrams showing a conveying path in the case of feeding an A4 size print medium S from the first cassette 5A. A print medium S at the top of a stack of printing media in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
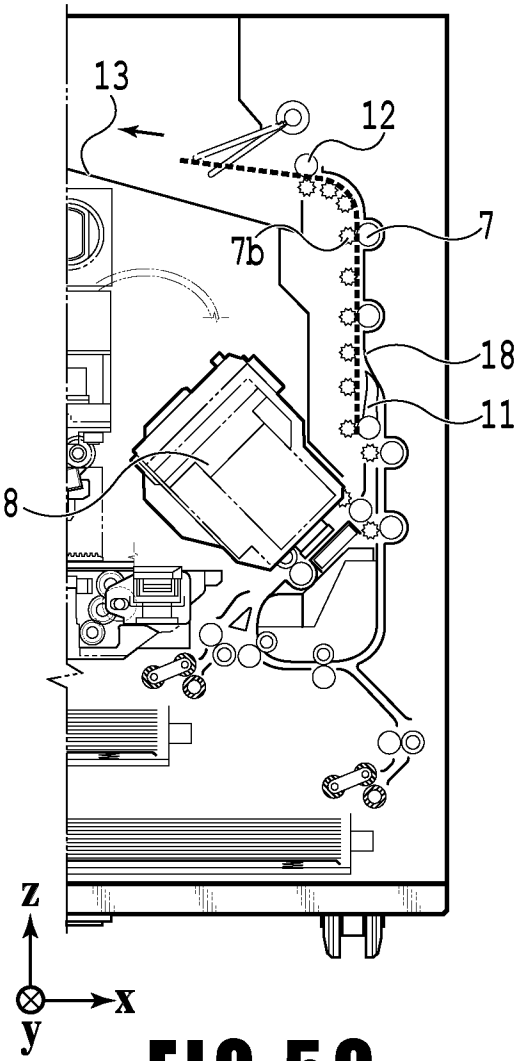
FIG. 5A, FIG. 5B, and FIG. 5C are views of a conveying path of a print medium fed from a second cassette.
Figure 5B:
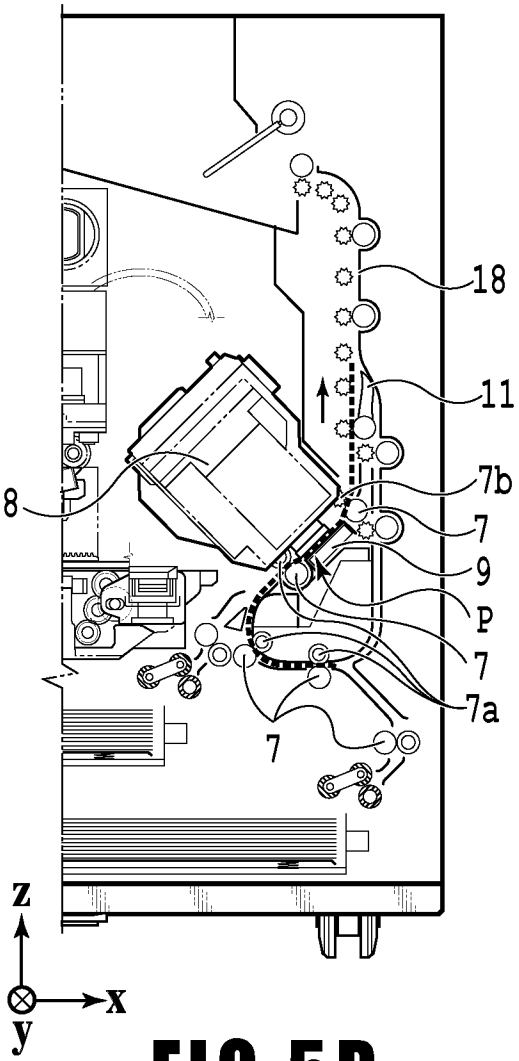
Figure 5A:
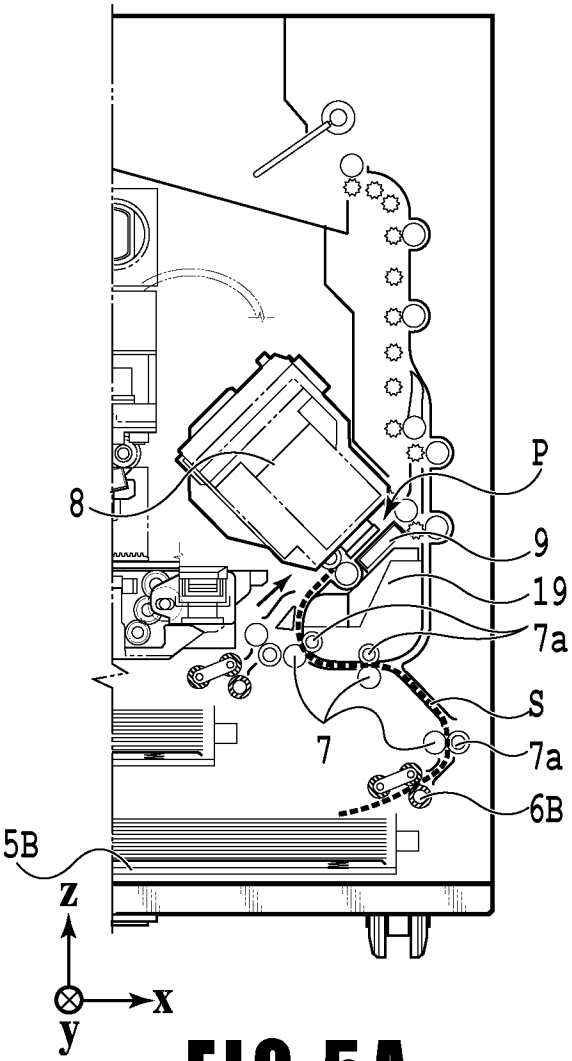

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
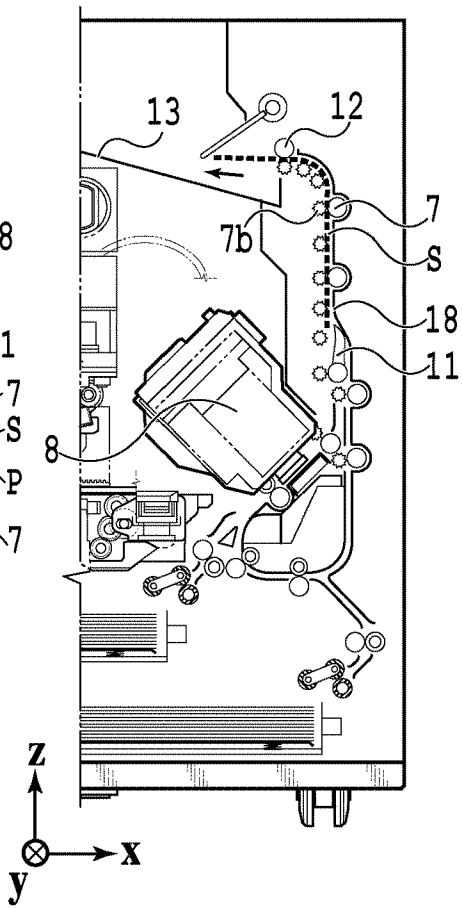
FIG. 6A, FIG. 6B, FIG. 6C, and FIG. 6D are views of a conveying path used in a case of performing a print operation on the back surface of a print medium.
Figure 6C:
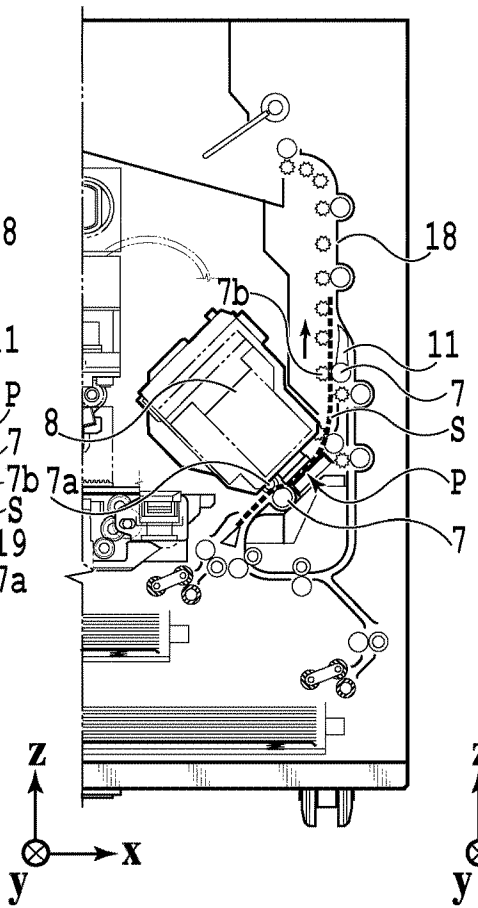
Figure 6B:
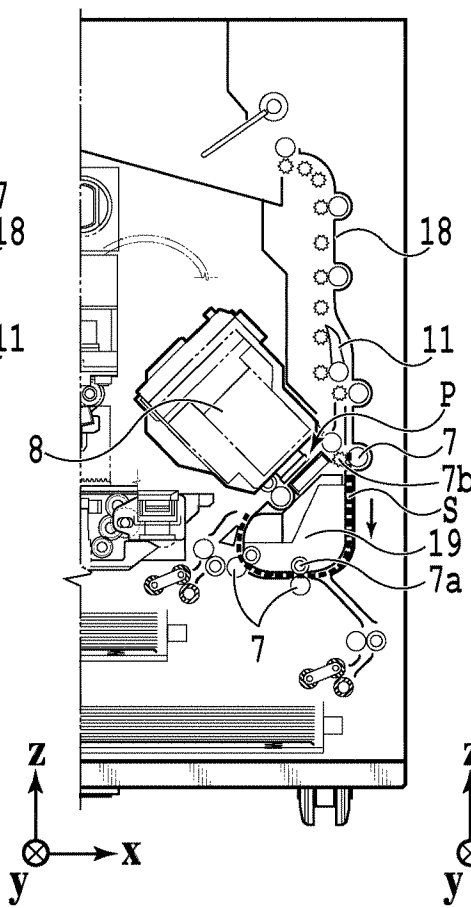
Figure 6A:
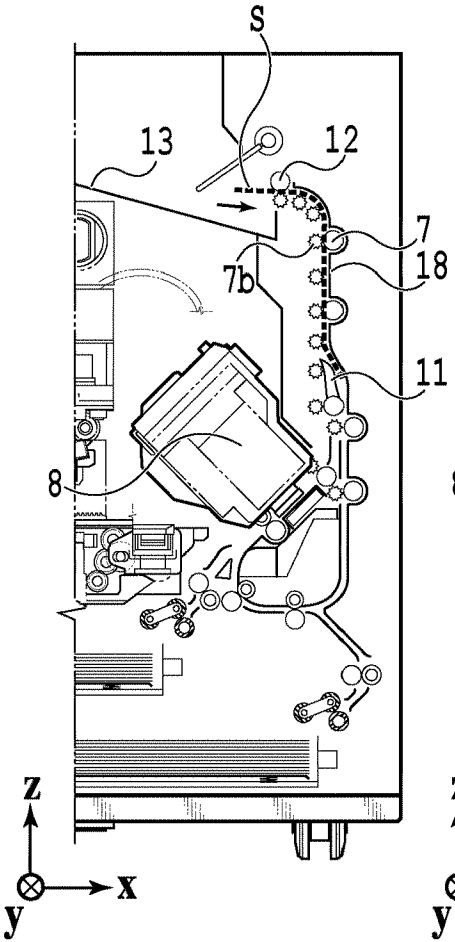

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
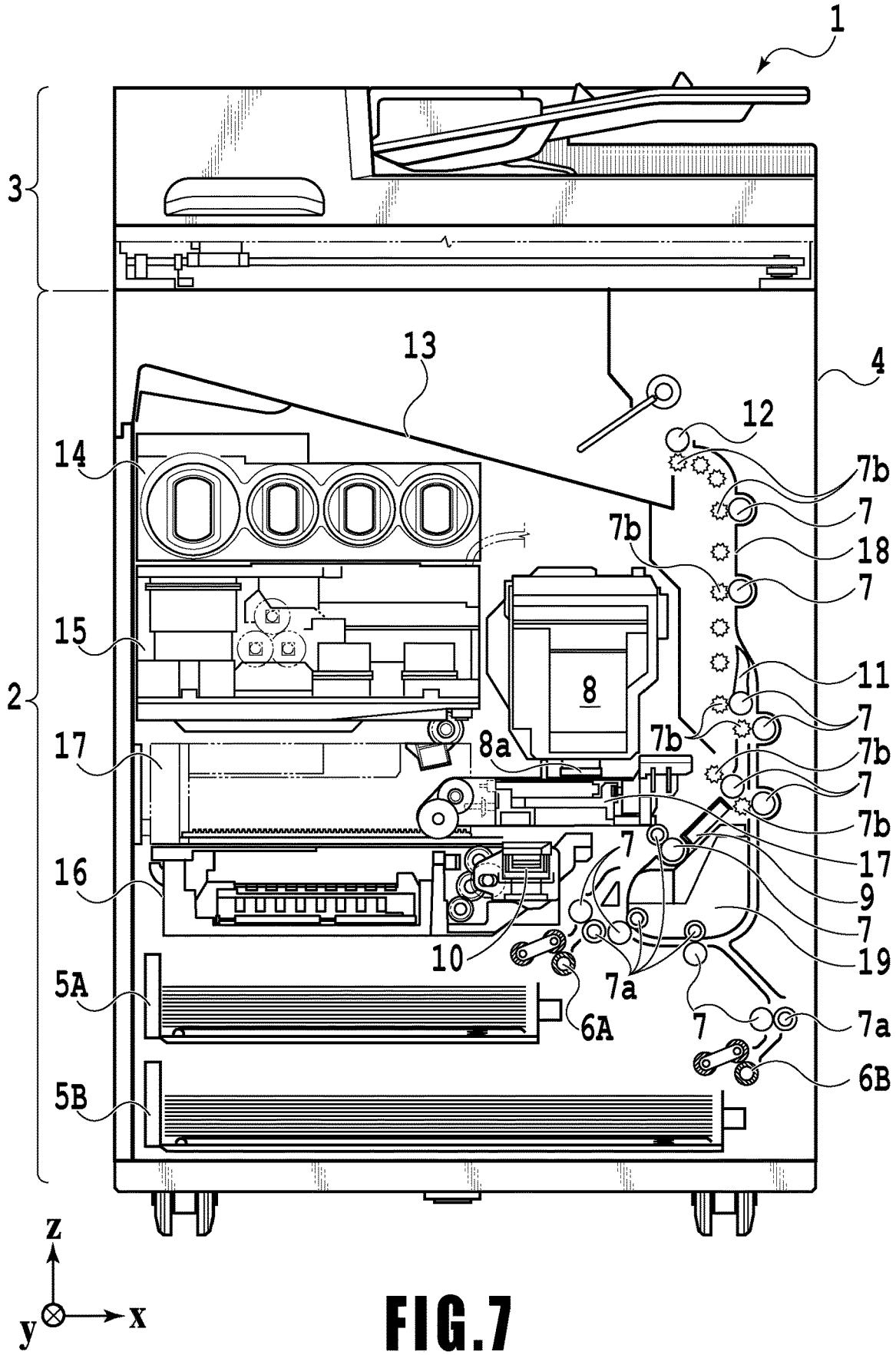
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
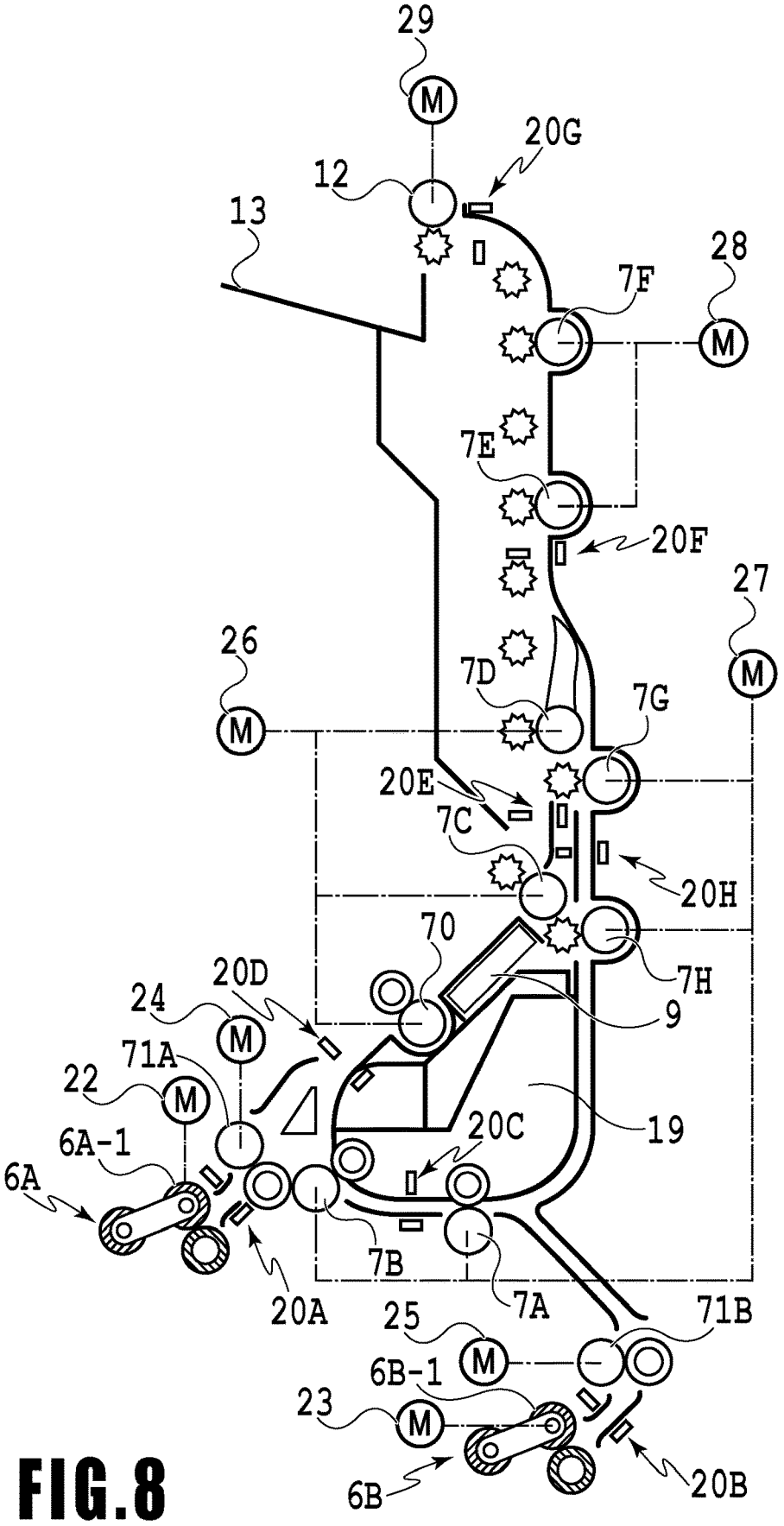
FIG. 8 is a diagram illustrating the association between drive rollers and motors.

FIG. 8 is a diagram illustrating the association between the plurality of motors and the drive rollers in the printing apparatus 1. A first feed motor 22 drives a feed roller of the first feed unit 6A that feeds a print medium S from the first cassette 5A. A second feed motor 23 drives a feed roller of the second feed unit 6B that feeds a print medium S from the second cassette 5B. A first conveyance motor 24 drives a first intermediate roller 71A being the first roller to convey the print medium S fed from the first feed unit 6A. A second conveyance motor 25 drives a second intermediate roller 71B being the first roller to convey the print medium S fed from the second feed unit 6B.

A main conveyance motor 26 drives a main conveyance roller 70 that is disposed upstream of the platen 9 and mainly conveys a print medium S which is being printed. The main conveyance motor 26 also drives two conveyance rollers 7C and 7D that are disposed downstream of the platen 9 and convey further downstream the print medium S conveyed by the main conveyance roller 70.

A third conveyance motor 27 drives two conveyance rollers 7G and 7H that convey downward a print medium S printed on the first surface. The third conveyance motor 27 also drives two conveyance rollers 7A and 7B that are disposed along the inner guide 19 and convey, toward the print head 8, a print medium S conveyed by the second intermediate roller 71B or a print medium S printed on the first surface and flipped upside down.

A fourth conveyance motor 28 drives two conveyance rollers 7 that convey upward or downward a print medium S having finished its printing operation. A discharge motor 29 drives the discharge roller 12, which discharges a printed print medium S onto the discharge tray 13. As described above, the two feed motors 22 and 23, the five conveyance motors 24 to 28, and the discharge motor 29 are each associated with one or more drive rollers.

On the other hand, at eight positions along the conveyance paths are disposed the sensing members 20 (sensing members 20A to 20H), each of which senses the presence or absence of a print medium S. Each sensing member 20 includes a sensor and a mirror disposed on the opposite sides of the conveyance path. The sensor, including a light emitting portion and a light receiving portion, is disposed on one side of the conveyance path while the mirror is disposed on the other side of the conveyance path at a position facing the sensor. Whether a print medium S is present, that is, whether its leading edge or trailing edge is passing, is determined based on whether light emitted from the light emitting portion of the sensor is reflected by the mirror and received by the light receiving portion.

The conveyance control unit 207 controls the conveyance in the entire apparatus by individually driving the feed motors 22 and 23, the conveyance motors 24 to 28, and the discharge motor 29 based on the results of sensing by the plurality of sensing members 20 and the output values of the encoders that detect the amounts of rotation of the respective drive rollers.

Figure 9A:
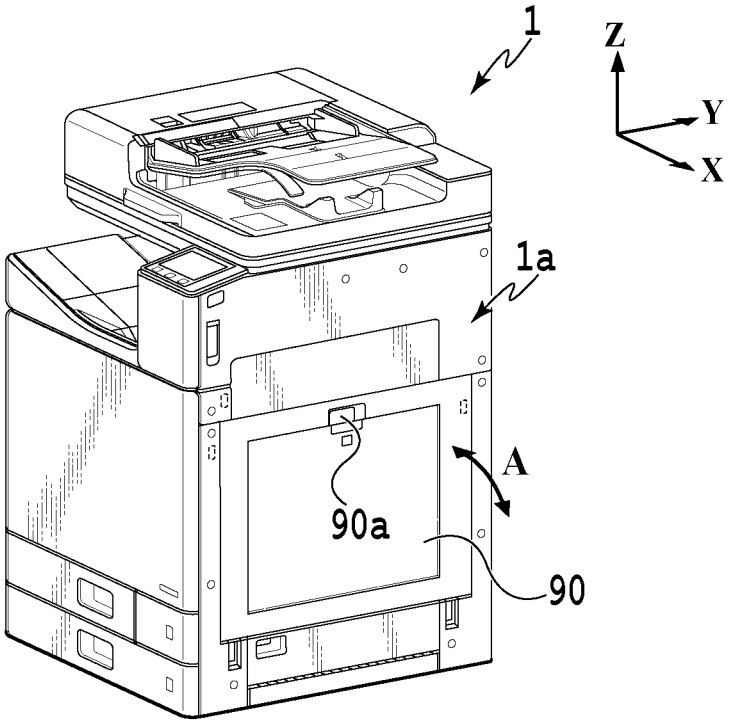
FIGS. 9A and 9B are schematic perspective configuration diagrams of the printing apparatus.
Figure 9B:
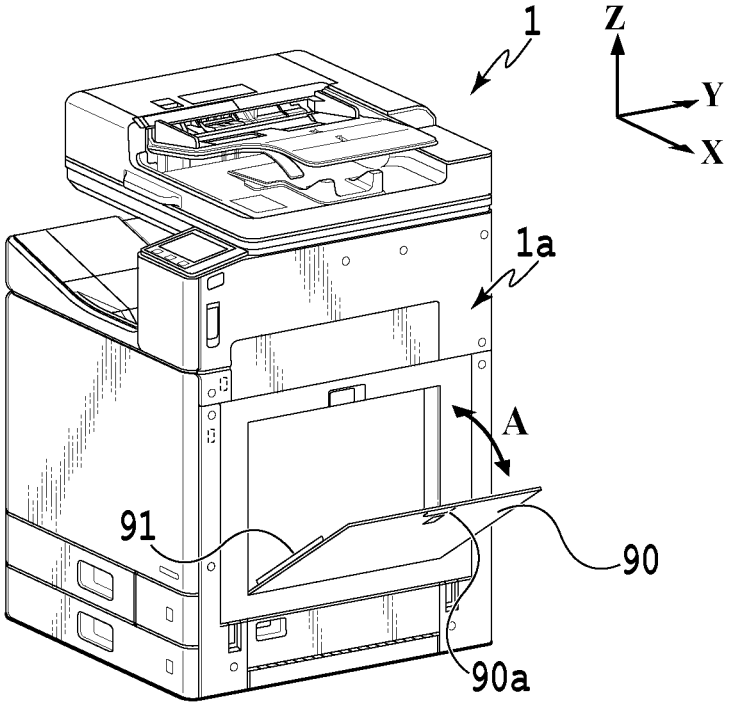
Figure 10:
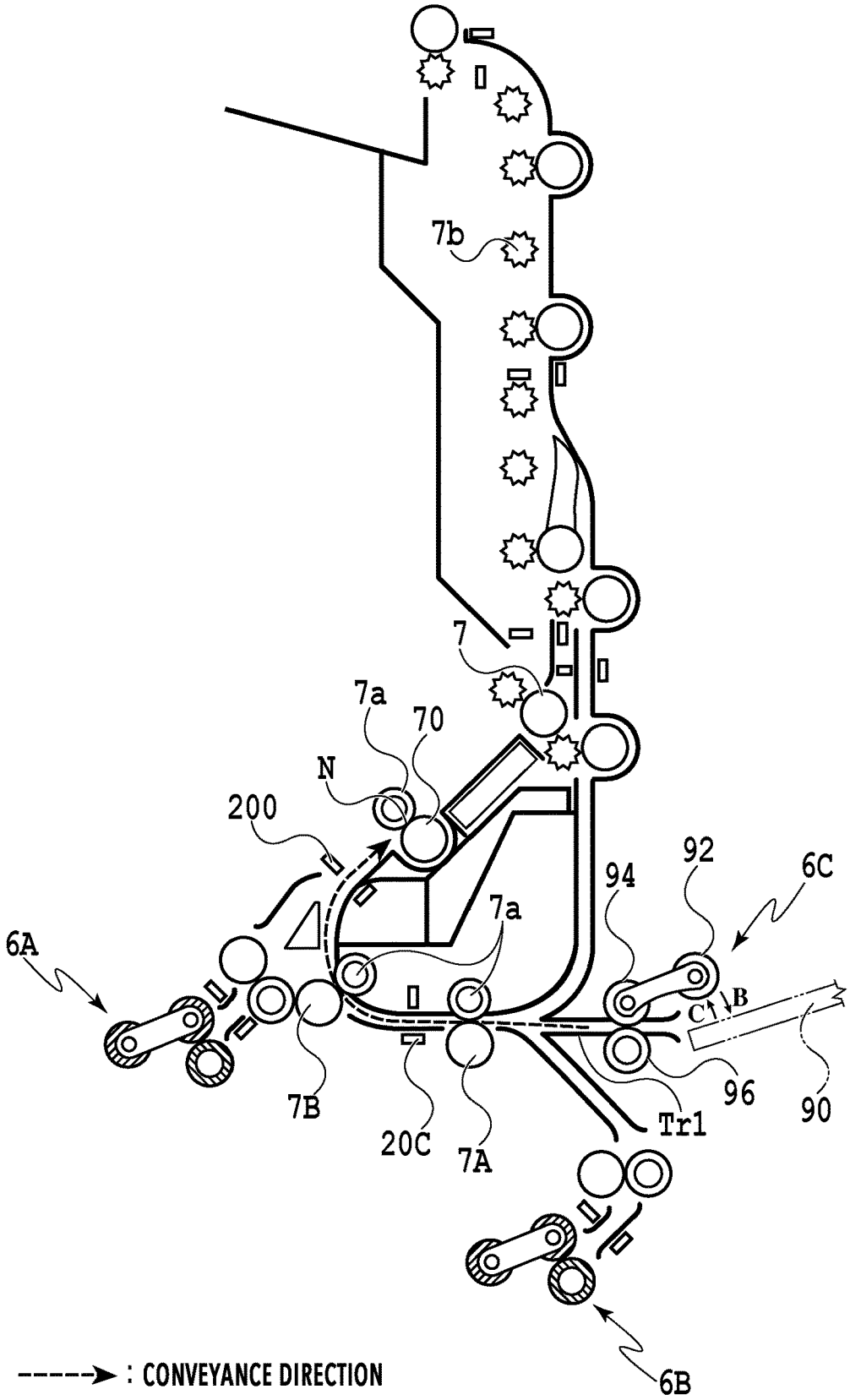
FIG. 10 is an explanatory diagram illustrating a conveyance path for a print medium S including a conveyance path from a manual feed tray.

The printing apparatus 1 includes a manual feed tray 90 (described later) on which print media S of various sizes can be loaded, and is configured to be capable of conveying a print medium S loaded on the manual feed tray 90 to the print section 2 and printing the print medium S. Now, the manual feed tray 90 and a mechanism for conveying a print medium S loaded on the manual feed tray 90 will be described with reference to FIGS. 9A, 9B, and 10. FIG. 9A is a schematic perspective view of the printing apparatus 1 with the manual feed tray 90 closed, and FIG. 9B is a schematic perspective view of the printing apparatus 1 with the manual feed tray 90 opened. Also, FIG. 10 is an explanatory diagram illustrating a conveyance path for a print medium S including a conveyance path from the manual feed tray 90.

The manual feed tray 90 is provided on a side surface 1*a* of the printing apparatus 1 so as to be openable and closable. Specifically, the manual feed tray 90 is configured to be pivotable in the directions of arrows A about an axis extending in a horizontal direction (y direction). Also, a grip portion 90*a* is formed at an externally exposed region of the manual feed tray 90. The user opens the manual feed tray 90 with this grip portion 90*a*.

When the manual feed tray 90 is opened, there is an opening portion (not illustrated) communicating with a manual-feed conveyance path Trl. Near this opening portion, a third feed unit 6C is provided which feeds a print medium S inserted thereinto (see FIG. 10). A print medium S fed into the manual-feed conveyance path Trl is transferred into the main conveyance path by this third feed unit 6C (feed unit) and then conveyed to the main conveyance roller 70 by the conveyance rollers 7A and 7B. Note that the main conveyance path is the conveyance path for conveying a print medium S fed from the cassette 5A or 5B (including the conveyance path for conveying a print medium S for printing its second surface (back surface).

Meanwhile, when opened, the manual feed tray 90 is held by its own weight in a hold position in which its free end side is located higher than its pivotal center side (see FIG. 9B). Thus, the printing apparatus 1 is configured such that a print medium S loaded on the manual feed tray 90 is easily inserted into the opening portion located near the pivotal center of the manual feed tray 90. Further, on the surface of the manual feed tray 90 on which to load print media S, paired guides 91 are provided which can move in conjunction with each other along the y direction (see FIG. 9B). Note that only one of the paired guides 91 is illustrated in FIG. 9B. With these paired guides 91, the print media S loaded on the manual feed tray 90 can have their two ends in the y direction (the width direction perpendicular to the conveyance direction of the print media S) aligned. Further, with the paired guides 91, the print media S loaded on the manual feed tray 90 can have their center position in the y direction substantially coincide with the center position of the manual feed tray 90 in they direction.

These paired guides 91 are connected to the conveyance control unit 207, and the conveyance control unit 207 is configured to obtain information on the size of the print media S in the conveyance direction when the print media S are positioned by the paired guides 91. Specifically, the conveyance control unit 207 obtains information on the size of the print media S in the width direction by means of the paired guides 91 and obtains information on the size of the print media S in the conveyance direction based on the information on the size in the width direction and information on the standardized sizes of print media S stored in advance. In this embodiment, print media S are placed on the manual feed tray 90 in such an orientation that their size in the conveyance direction is larger than their size in the width direction. In this case, the paired guides 91 and the conveyance control unit 207 function as an obtaining unit (first obtaining unit) that obtains the size of the print media S in the conveyance direction. Note that the information on the size of the print media S in the predetermined direction may be obtained by the print controller 202.

The third feed unit 6C includes a first feed roller 92 that picks up a print medium S loaded on the manual feed tray 90 and inserted in the opening portion, and a second feed roller 94 that feeds the print medium S picked up and transferred by the first feed roller 92. The third feed unit 6C also includes a separation roller 96 that can, when a plurality of print media S are transferred by the first feed roller 92, separate the top print medium from the rest of the print media S so as to allow the second feed roller 94 to feed only the top print medium S.

The first feed roller 92 is configured to rise and lower by revolving about the center of rotation of the second feed roller 94. Specifically, the first feed roller 92 revolves in the direction of arrow B (see FIG. 10) from an initial position to thereby lower. By lowering, the first feed roller 92 comes into pressure contact with the top print medium S among the print media S loaded on the manual feed tray 90 and inserted from the opening portion. Also, the first feed roller 92 revolves in the direction of arrow C (see FIG. 10) from the position at which it is in pressure contact with the print medium S to thereby rise. As a result, the first feed roller 92 moves away from the print medium S. The length of the outer periphery of the first feed roller 92 (i.e. the circumferential length of the first feed roller 92) is set to be shorter than the smallest of the lengths, in the conveyance direction, of the print media S that are expected to be used, for example. The print media S loaded on the manual feed tray 90 have their center positions aligned with the center position of the manual feed tray 90 in they direction by the paired guides 91. Moreover, the first feed roller 92 is provided at a position coinciding with the center position of the manual feed tray 90 in the y direction (see FIG. 11) so that the first feed roller 92 can pick up a print medium S loaded on the manual feed tray 90 regardless of its size.

Figure 11:
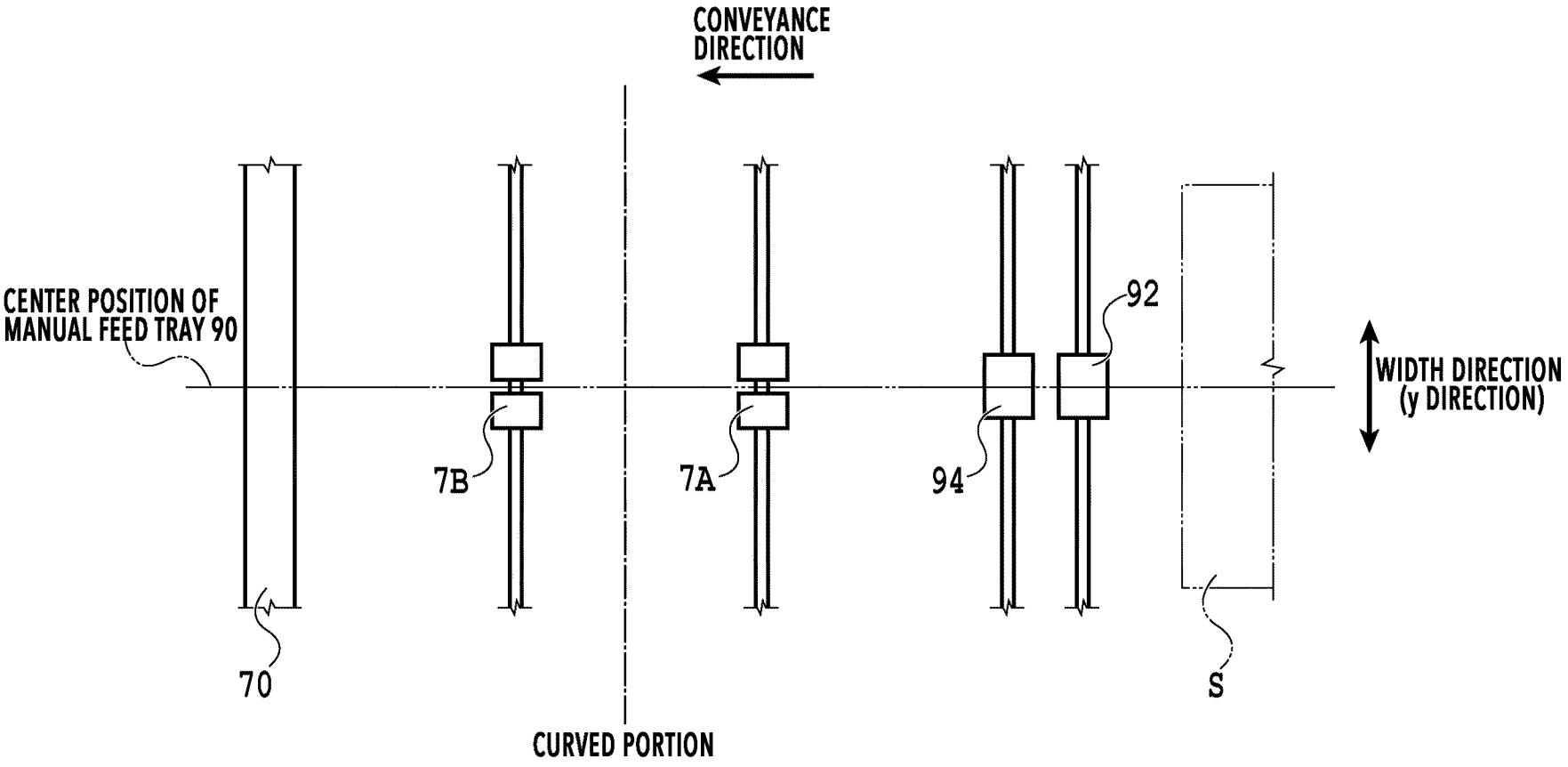
FIG. 11 is a diagram illustrating the positional relations of conveyance rollers and feed rollers with a print medium.

The second feed roller 94 is provided at a position coinciding with the center position of the manual feed tray 90 in they direction (see FIG. 11). The distance from the second feed roller 94 (the nip portion between the second feed roller 94 and the separation roller 96) to the conveyance roller 7B (the nip portion between the conveyance roller 7B and its pinch roller 7*a*) along the conveyance path is shorter than the smallest of the lengths, in the conveyance direction, of the print media S that can be fed from the manual feed tray 90. Also, the distance from the conveyance roller 7A (the nip portion between the conveyance roller 7A and its pinch roller 7*a*) to the main conveyance roller 70 (the nip portion between the main conveyance roller 70 and its pinch roller 7*a*) along the conveyance path is also shorter than the smallest of the lengths, in the conveyance direction, of the print media S that can be fed from the manual feed tray 90.

The separation roller 96 is provided so as to be capable of coming into contact with and moving away from the second feed roller 94. Specifically, the separation roller 96 is provided so as to be capable of rising and lowering by using a lifting mechanism (not illustrated), for example, and rises to come into pressure contact with the second feed roller 94 and lowers to move away from the second feed roller 94.

The first feed roller 92 and the second feed roller 94 are driven by drive force from the same drive motor (not illustrated). Also, with a torque limiter (not illustrated), the separation roller 96 is configured to receive load when rotating. The lifting mechanisms for the first feed roller 92 and the separation roller 96 are each driven by a lifting motor (not illustrated). Note that these drive motor and lifting motors are controlled by the conveyance control unit 207 (printer controller 202) through the drive unit 211. Also, publicly known techniques are usable for the lifting mechanisms.

A print medium S fed through the manual-feed conveyance path Trl from the manual feed tray 90 is conveyed by the conveyance rollers 7A and 7B to the main conveyance roller 70, located on a downstream side of the main conveyance path. Then, the print medium S thus conveyed is brought into abutment with a nip portion N between the main conveyance roller 70, which is stopped, and its pinch roller 7*a* (first conveyance unit), and the print medium S is further conveyed by a predetermined amount in the abutting state. Note that in this specification, the conveyance of a print medium S by a predetermined amount in the abutting state will be referred to as "overfeed" as appropriate. As a result, the print medium S is caused to bow, so that its skew is corrected.

Here, FIG. 11 is a diagram illustrating the first feed roller 92, the second feed roller 94, the conveyance rollers 7A and 7B, and the main conveyance roller 70, disposed along a conveyance path. Note that the conveyance path is depicted straight in FIG. 11 to facilitate the understanding. The conveyance rollers 7A and 7B are in pressure contact with their pinch rollers 7*a* (second conveyance unit), and each of the conveyance rollers 7A and 7B and its pinch roller 7*a* pinch and convey a print medium S. The conveyance rollers 7A and 7B are each configured to be capable of holding a conveyed print medium S between itself and its corresponding pinch roller 7*a* at a substantially center position of the print medium S in the width direction. Specifically, the conveyance rollers 7A and 7B are provided at positions coinciding with the center position of the manual feed tray 90 in they direction. In this way, the conveyance rollers 7A and 7B can properly pinch a print medium S regardless of its size in the width direction.

Also, contact pressure between the conveyance rollers 7A and 7B and their pinch rollers 7*a* is set to be lower than contact pressure between the other conveyance rollers, such as the main conveyance roller 70, and their pinch rollers 7*a*. Since contact pressure between the conveyance rollers 7A and 7B and their pinch rollers 7*a* is small and the conveyance rollers 7A and 7B pinch a conveyed print medium S at a substantially center position in its width direction as described above, the skew of the print medium S is easily corrected when it is overfed with the leading edge in abutment with the nip portion N.

Note that the conveyance path is curved between the conveyance rollers 7A and 7B and between the conveyance roller 7B and the main transport roller 70 (see FIG. 10). With such a curved conveyance path, the load applied to a print medium S conveyed therethrough increases in proportion to the length in the width direction (y direction). For example, the load applied to a print medium S at the curved portion of the conveyance path between the conveyance rollers 7A and 7B (the portion indicated by the chain line in FIG. 11) increases by 2 gf as the length of the print medium S in the width direction increases by 1 mm. When the leading edge of a print medium S is located between the conveyance roller 7B and the main conveyance roller 70, the print medium S is being conveyed by the conveyance rollers 7A and 7B, i.e. two drive rollers. On the other hand, when the leading edge of a print medium S is located between the conveyance rollers 7A and 7B, the print medium S is being conveyed by the conveyance roller 7A, i.e. a single drive roller. Note that, as mentioned above, contact pressure of the conveyance rollers 7A and 7B with their pinch rollers 7*a* is set to be lower than that of the other conveyance rollers.

As described above, when the leading edge of a print medium S is located between the conveyance rollers 7A and 7B, the print medium S is or will be conveyed through the curved conveyance path, at which the load increases, by the conveyance roller 7A, which is in pressure contact with its pinch roller 7*a* with lower force. Thus, the larger the size of the print medium, the greater the likelihood of slip of the conveyance roller 7A on the print medium S or the like, for example, and thus the greater the likelihood of failing to properly convey the print medium S between the conveyance rollers 7A and 7B. As will be described later in detail, in the invention of the present application, in the case of conveying a print medium S of a large size between the conveyance rollers 7A and 7B, not only the conveyance roller 7A but also the second feed roller 94 applies conveyance force to the print medium S. Thus, the printing apparatus 1 includes a conveyance device that causes the second feed roller 94 to apply conveyance force to a print medium S conveyed by the conveyance roller 7A in the case where the size of the fed print medium S in the conveyance direction is large. In this way, additional conveyance force is applied to the print medium S at a curved conveyance path where the print medium S conveyed therethrough receives increased load, thereby suppressing the occurrence of abnormal conveyance. Note that the conveyance force to be applied may be changed in accordance with the size of the print medium S in the conveyance direction. For example, the conveyance force to be applied may increase the larger the size of the print medium S in the conveyance direction.

Figures 12, 12A:
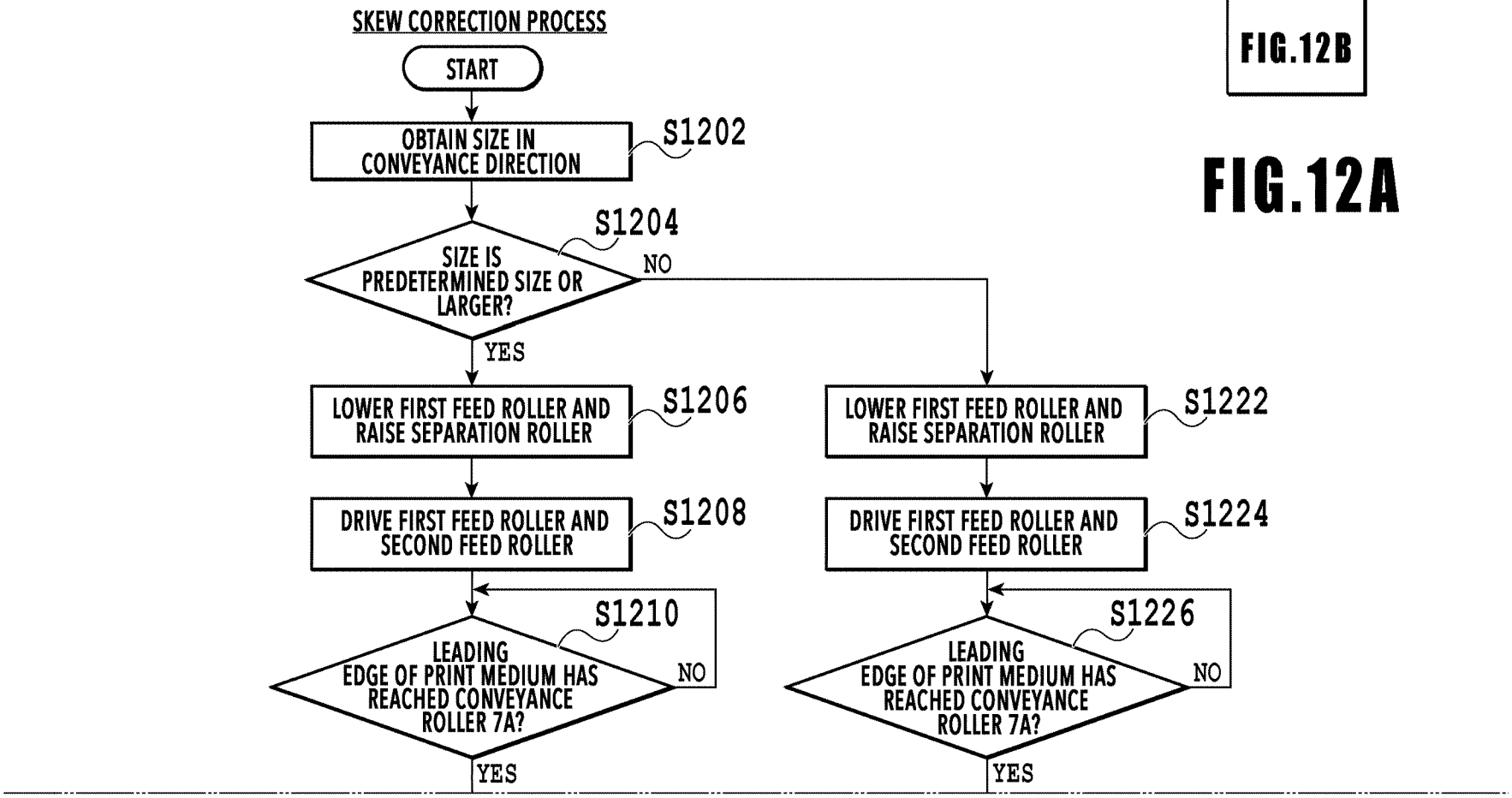
FIG. 12 is a diagram showing a relationship between FIGS. 12A and 12B.
FIGS. 12A and 12B are flowcharts illustrating processing routines in a skew correction process.
Figure 12B:
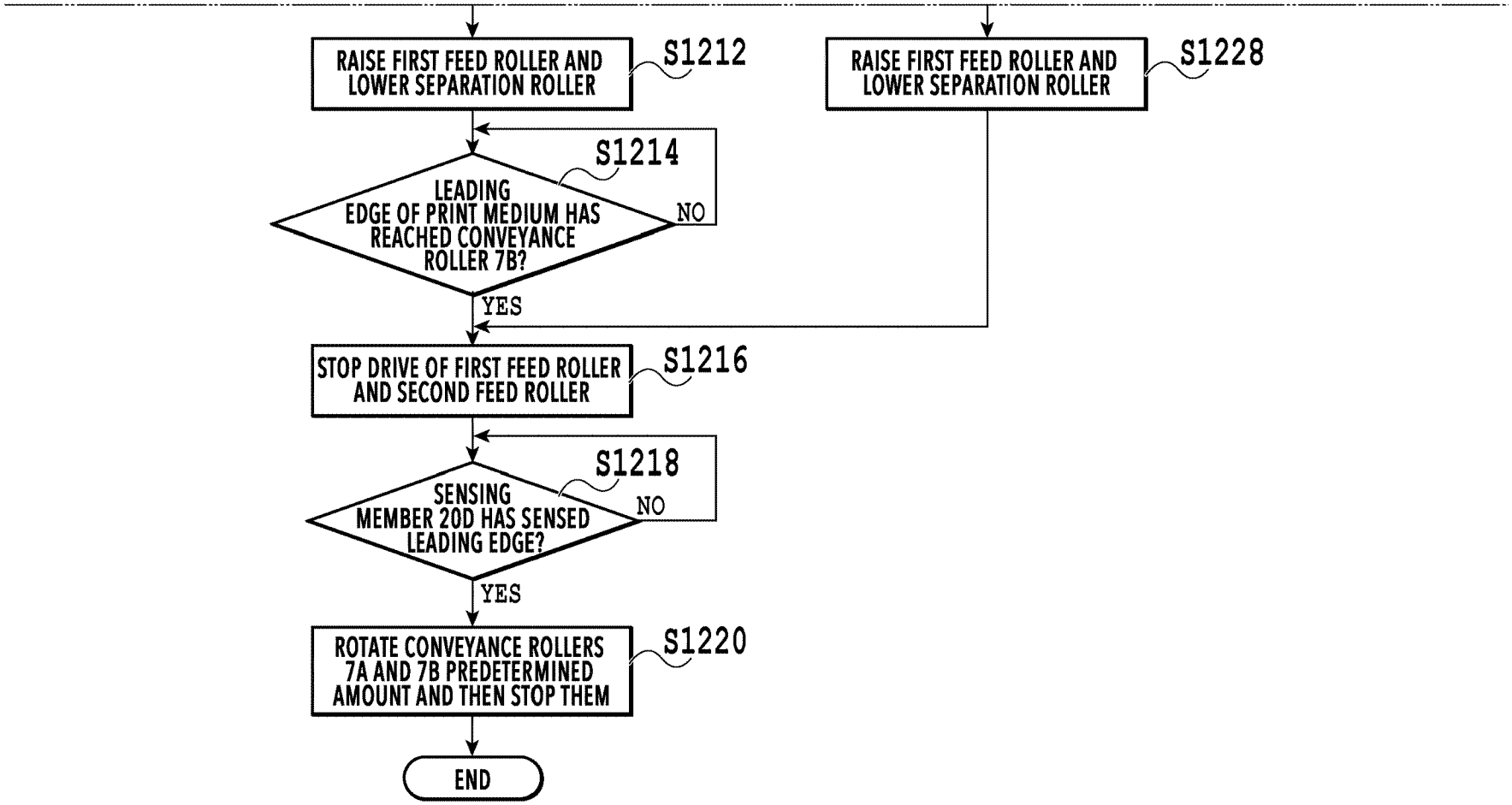
Figure 13A:
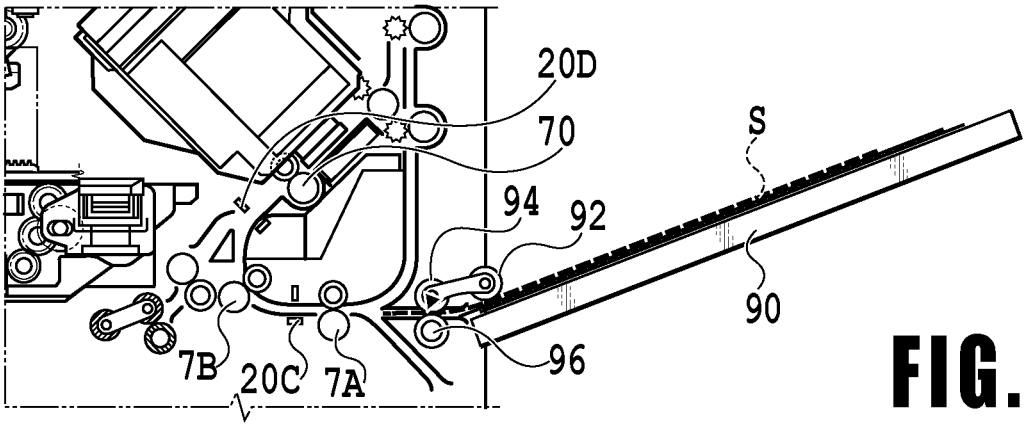
FIGS. 13A, 13B, 13C, and 13D are transition diagrams explaining the feed of a print medium of a large size.
Figure 13B:
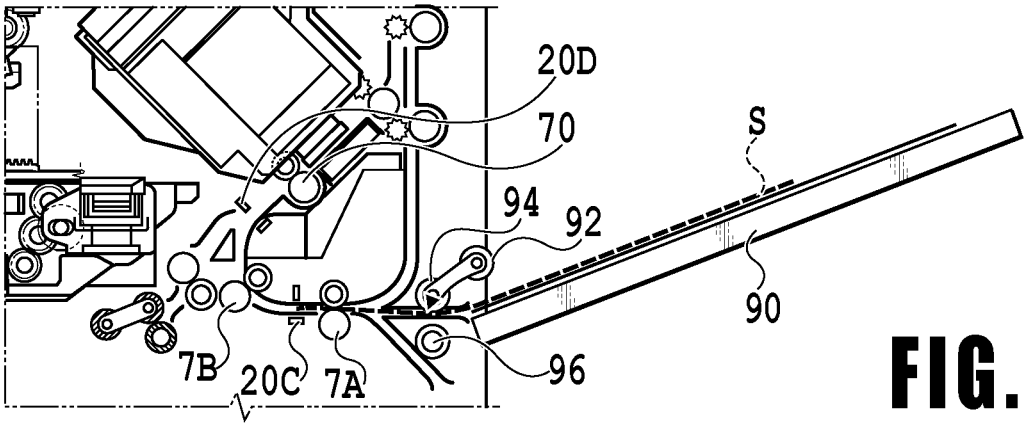
Figure 13C:
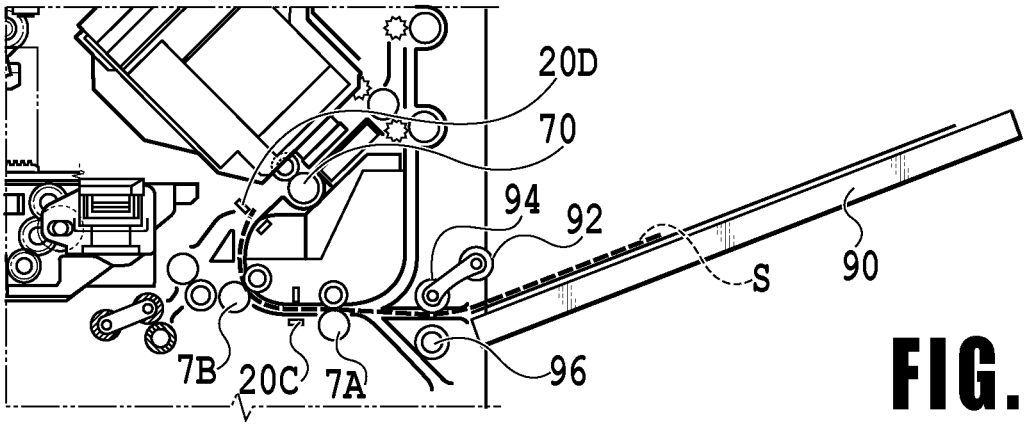

With the above configuration, a printing process to print a print medium S loaded on the manual feed tray 90 is executed by executing a skew correction process on the print medium S to be printed and printing the print medium S having finished the skew correction based on various pieces of information. Now, the skew correction process will be described in detail with reference to FIGS. 12 to 14C. FIGS. 12A and 12B are flowcharts illustrating details of the content of processing in the skew correction process. FIGS. 13A, 13B, 13C, and 13D are transition diagrams for explaining the feed of a print medium S whose size in the conveyance direction is a predetermined size or larger. FIGS. 14A, 14B, and 14C are transition diagrams for explaining the feed of a print medium S whose size in the conveyance direction is smaller than the predetermined size.

Once the skew correction process starts, first, information on the size, in the conveyance direction, of print media S loaded on the manual feed tray 90 is obtained (S1202). Specifically, in S1202, the conveyance control unit 207 obtains the information on the size, in the width direction, of print media S positioned by the paired guides 91. Then, the conveyance control unit 207 obtains information on the size, in the conveyance direction, of the print media S based on this information on the size in the width direction and the information on the standardized sizes of print media S stored in advance.

Although the information on the size of the print media S in the conveyance direction is obtained based on the information on the size in the width direction obtained by means of the paired guides 91 in this embodiment, the present invention is not limited to this. Specifically, the user may directly input the information on the size of the print media S in the conveyance direction. Alternatively, the user may input information on the standardized size of the print media S to be conveyed (e.g. A3, A4, etc.) and their orientation and the conveyance control unit 207 may obtain the information on the size of the print media S in the conveyance direction based on the information thus input. Still alternatively, on the surface of the manual feed tray 90 for loading print media S, a member may be provided which can obtain the information on the size of the loaded print media S in the conveyance direction.

Thereafter, based on the obtained information on the size of the print media S in the conveyance direction, the conveyance control unit 207 determines whether or not the size in the conveyance direction is a predetermined size or larger (S1204). The predetermined size is, for example, the smallest size (in the conveyance direction) with and above which a print medium S cannot be properly conveyed to the conveyance roller 7B by the conveyance roller 7A alone. This predetermined size is stored in the conveyance control unit 207. If determining in S1204 that the size in the conveyance direction is the predetermined size or larger, the conveyance control unit 207 controls the first feed roller 92 to lower and controls the separation roller 96 to rise (S1206). As a result, the first feed roller 92 is brought into pressure contact with the top print medium S among the print media S loaded on the manual feed tray 90, and the separation roller 96 is brought into pressure contact with the second feed roller 94.

Then, the conveyance control unit 207 drives the first feed roller 92 and the second feed roller 94 with their drive motor (S1208) and determines whether or not the leading edge of a print medium S has reached the conveyance roller 7A (S1210). Consequently, as illustrated in FIG. 13A, only the top print medium S among the plurality of print media S loaded on the manual feed tray 90 is fed by the second feed roller 94.

Meanwhile, the determination in S1210 is made based on the result of sensing by the sensing member 20C, provided between the conveyance roller 7A and the conveyance roller 7B. Specifically, if the sensing member 20C senses the leading edge of the print medium S, the conveyance control unit 207 determines that the print medium S has reached the conveyance roller 7A. If the sensing member 20C does not sense the leading edge, the conveyance control unit 207 determines that the print medium S has not reached the conveyance roller 7A. Note that the determination in S1210 may be made from the number of rotations of the second feed roller 94 based on the circumferential length of the first feed roller 92, the circumferential length of the second feed roller 94, and the distance from the second feed roller 94 to the conveyance roller 7A (the nip portion between the conveyance roller 7A and its pinch roller 7*a*), for example.

If determining in S1210 that the print medium S has not reached the conveyance roller 7A, the conveyance control unit 207 executes the process in S1210 again. On the other hand, if determining in S1210 that the print medium S has reached the conveyance roller 7A, the conveyance control unit 207 raises the first feed roller 92 and lowers the separation roller 96 (S1212). Specifically, in S1212, as illustrated in FIG. 13B, the conveyance control unit 207 raises the first feed roller 92, so that the first feed roller 92 is moved away from the print medium S loaded on the manual feed tray 90 (the fed print medium S). The conveyance control unit 207 also lowers the separation roller 96, so that the separation roller 96 is moved away from the second feed roller 94. Note that, in this step, the second feed roller 94 remains driven in contact with the fed print medium S. Specifically, in this embodiment, in the case where the size of the print medium S in the conveyance direction is the predetermined size or larger, the second feed roller 94 is caused to apply conveyance force to the print medium S even after it reaches the conveyance roller 7A.

In this embodiment, in S1210, the second feed roller 94 is caused to apply conveyance force to the print medium S conveyed by the conveyance roller 7A with the separation roller 96 moved away from the second feed roller 94. However, the present invention is not limited to this. Specifically, in S1210, the separation roller 96 may remain in pressure contact with the second feed roller 94 as long as the second feed roller 94 can apply conveyance force efficiently to the print medium S conveyed by the conveyance roller 7A.

Thereafter, the conveyance control unit 207 determines whether or not the leading edge of the print medium S has reached the conveyance roller 7B (S1214). Specifically, the determination in S1214 is made based on the result of detection by the encoder 21 on the conveyance roller 7A following the sensing of the leading edge of the print medium S by the sensing member 20C and on the distance from the sensing member 20C to the conveyance roller 7B (the nip portion between the conveyance roller 7B and its pinch roller 7*a*) stored in advance. More specifically, the conveyance control unit 207 calculates the amount of conveyance following the sensing by the sensing member 20C from the amount of rotation of the conveyance roller 7A detected by the encoder 21 thereon and the circumferential length of the conveyance roller 7A. Then, if the calculated value reaches the distance from the sensing member 20C to the conveyance roller 7B stored in advance, the conveyance control unit 207 determines that the print medium S has reached the conveyance roller 7B. If the calculated value has not reached this distance, the conveyance control unit 207 determines that the print medium S has not reached the conveyance roller 7B. Note that the determination in S1214 may be made from the number of rotations of the second feed roller 94 or the like based on the circumferential length of the first feed roller 92, the circumferential length of the second feed roller 94, and the distance from the second feed roller 94 to the conveyance roller 7B, for example.

If determining in S1214 that the leading edge of the print medium S has not reached the conveyance roller 7B, the conveyance control unit 207 executes the process in S1214 again. On the other hand, determining in S1214 that the leading edge of the print medium S has reached the conveyance roller 7B, the conveyance control unit 207 stops the drive of the first feed roller 92 and the second feed roller 94, as illustrated in FIG. 13C (S1216). Specifically, in this embodiment, in the case where the size of the print medium S in the conveyance direction is the predetermined size or larger, the second feed roller 94 is caused to apply conveyance force to the print medium S until it reaches the conveyance roller 7B. In this embodiment, the conveyance control unit 207 (including the printer controller 202) functions as a control unit that controls the drive of the third feed unit 6C.

Then, the conveyance control unit 207 determines whether or not the sensing member 20D has sensed the leading edge of the print medium S (S1218). If determining in S1218 that the sensing member 20D has not sensed the leading edge of the print medium S, the conveyance control unit 207 executes the process in S1218 again. On the other hand, if determining in S1218 that the sensing member 20D has sensed the leading edge of the print medium S, the conveyance control unit 207 rotates the conveyance rollers 7A and 7B a predetermined amount and then stops them (S1220), and then terminates this skew correction process.

Figure 13D:
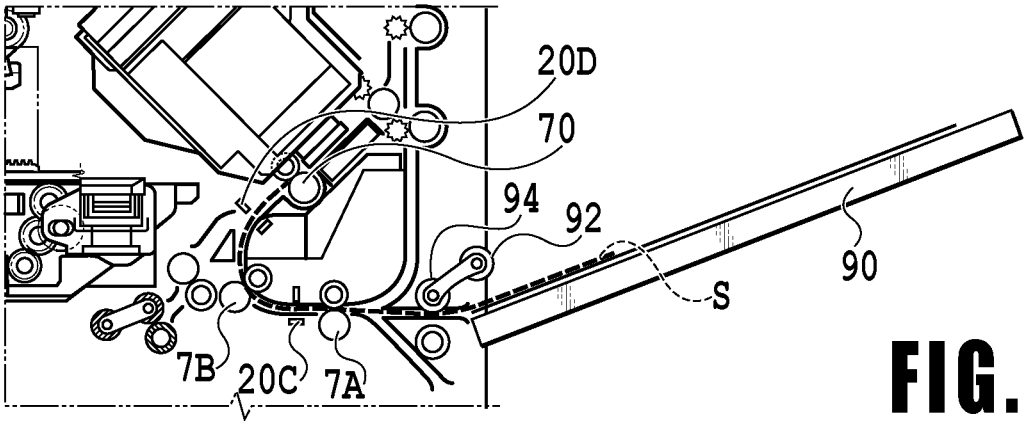
Figure 14A:
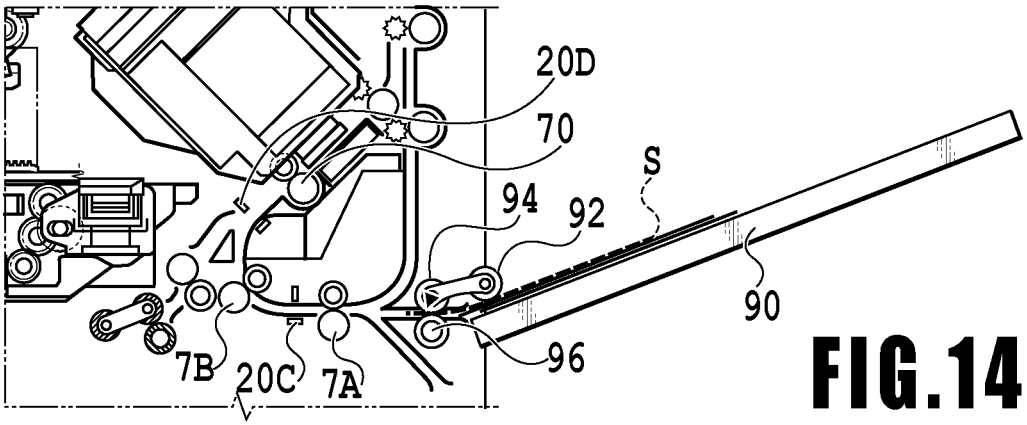
FIGS. 14A, 14B, and 14C are transition diagrams explaining the feed of a print medium of a small size.
Figure 14B:
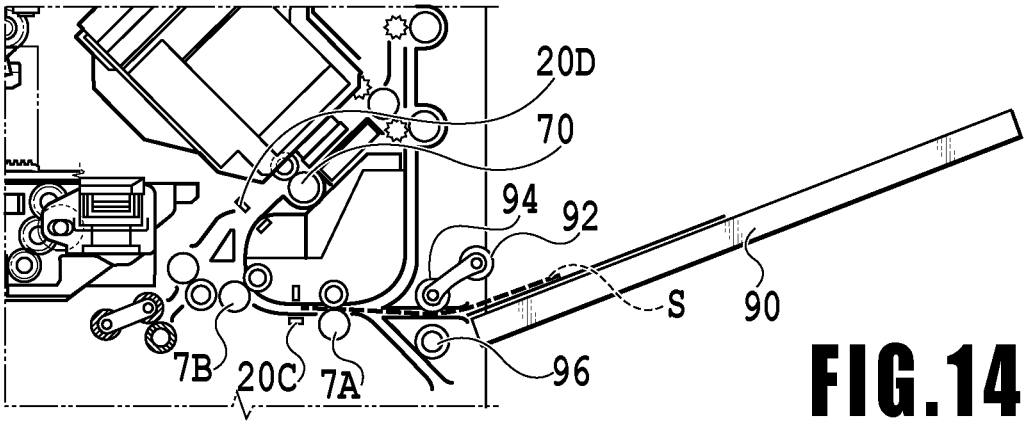
Figure 14C:
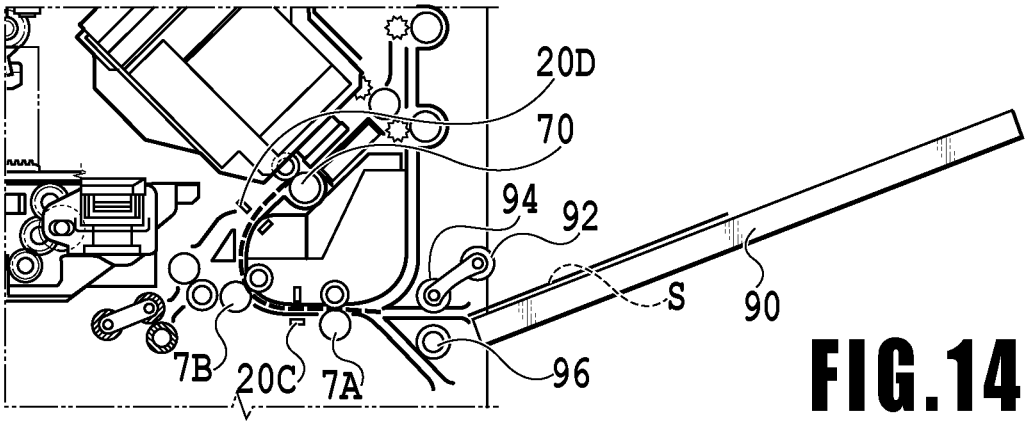

By the predetermined amount of rotation of the conveyance rollers 7A and 7B, the print medium S is overfed by a predetermined amount with its leading edge in abutment with the nip portion N of the main conveyance roller 70, which has been stopped, as illustrated in FIG. 13D. As a result, the skew of the print medium S is corrected.

On the other hand, if determining in S1204 that the size in the conveyance direction is not the predetermined size or larger, the conveyance control unit 207 lowers the first feed roller 92 and raises the separation roller 96 (S1222). Then, as illustrated in FIG. 14A, the conveyance control unit 207 drives the first feed roller 92 and the second feed roller 94 (S1224) and determines whether or not the leading edge of the print medium S has reached the conveyance roller 7A (S1226).

If determining in S1226 that the leading edge of the print medium S has not reached the conveyance roller 7A, the conveyance control unit 207 executes the process in S1226 again. On the other hand, if determining in S1226 that the leading edge of the print medium S has reached the conveyance roller 7A, the conveyance control unit 207 raises the first feed roller 92 and lowers the separation roller 96, as illustrated in FIG. 14B (S1228). Then, the conveyance control unit 207 proceeds to step S1216, in which the conveyance control unit 207 stops the drive of the first feed roller 92 and the second feed roller 94, and the conveyance control unit 207 executes the subsequent processes to correct the skew of the print medium S, as illustrated in FIG. 14C. Note that details of the contents of the processes in S1222 to S1228 are similar to those in S1206 to S1212, respectively, and description thereof is therefore omitted.

The print media S loaded on the manual feed tray 90 are of a standardized size and the sheets are oriented in the same direction when loaded. Thus, when the size in the conveyance direction is small, the size in the width direction is small as well and accordingly the load applied to each print medium S at a curved portion of the conveyance path is small. For this reason, in this embodiment, in the case where the size of the print medium S in the conveyance direction is not the predetermined size or larger, that is, the size of the print medium S in the conveyance direction is smaller than the predetermined size, the application of conveyance force from the second feed roller 94 to the print medium S is stopped when its leading edge reaches the conveyance roller 7A. Also, even in the case where the size of the print medium S in the conveyance direction is smaller than the predetermined size and therefore the size in the width direction is small, the print medium S can be properly conveyed since the conveyance rollers 7A and 7B are disposed at positions coinciding with the center position of the print medium S to be conveyed.

As described above, in the printing apparatus 1, the two conveyance rollers 7A and 7B are disposed along the conveyance direction between the second feed roller 94 and the main conveyance roller 70. In the case where the size of the print medium S loaded on the manual feed tray 90 is the predetermined size or larger, the second feed roller 94 (and the first feed roller 92) is caused to apply conveyance force even after the leading edge of the print medium S reaches the conveyance roller 7A (sensing member 20C). On the other hand, in the case where the size of the print medium S is smaller than the predetermined size, the application of conveyance force from the second feed roller 94 (and the first feed roller 92) is stopped when the leading edge of the print medium S reaches the conveyance roller 7A (the sensing member 20C). Thus, in the case where the print medium size is smaller than the predetermined size, the application of the additional conveyance force to the print medium S is stopped when the leading edge of the print medium S reaches the conveyance roller 7A. In this way, the printing apparatus 1 is less likely to experience multi-feed of print media.

Also, in the printing apparatus 1, contact pressure of the conveyance rollers 7A and 7B with their pinch rollers 7*a* is set to be lower than contact pressure of the main conveyance roller 70 with its pinch roller 7*a*. Further, the conveyance rollers 7A and 7B are disposed at positions coinciding with the center position, in the width direction, of the print medium S to be conveyed. In this way, in the printing apparatus 1, when the print medium S is overfed by the conveyance rollers 7A and 7B to bow, the skew of the print medium S is easily corrected. Moreover, even in the case where the print medium S is of a small size, the conveyance rollers 7A and 7B properly pinch the print medium S with their pinch rollers 7*a*. Hence, abnormal conveyance is less likely to occur.

Note that the above embodiment may be modified as (1) to (6) described below.

(1) Printing apparatuses to which the present invention is applicable are not limited only to inkjet printing apparatuses, but the present invention is applicable also to printing apparatuses that perform printing on a print medium by various methods. Also, printing apparatuses to which the present invention is applicable are not limited only to full line-type inkjet printing apparatuses such as the one in the above embodiment, but the present invention is applicable also to serial-type inkjet printing apparatuses, for example.

(2) In the above embodiment, it is determined in S1204 whether or not the size in the conveyance direction is a predetermined size or larger. However, the present invention is not limited to this. Specifically, in step S1204, whether or not the size in the conveyance direction is a predetermined size or smaller may be determined. In this case, the predetermined size is the largest size with and below which a print medium S can be properly conveyed by the conveyance roller 7A alone. Also, if it is determined that the size in the conveyance direction is the predetermined size or smaller, the processing proceeds to S1222. If it is determined that the size in the conveyance direction is not the predetermined size or smaller, the processing proceeds to S1206.

(3) In the above embodiment, each print medium S loaded on the manual feed tray 90 may be positioned by the paired guides 91 such that its center position in the y direction is offset toward one or the other side from the center position of the manual feed tray 90 in they direction. In this case, the positions of the first feed roller 92, the second feed roller 94, and the conveyance rollers 7A and 7B in the y direction are set to be offset from the center position in the y direction in accordance with the offset of the print medium S. Also, in the above embodiment, when a print medium S loaded on the manual feed tray 90 is conveyed, the second feed roller 94 is caused to apply conveyance force to it. However, the present invention is not limited to this. Specifically, when a print medium S loaded in the cassette 5A or 5B is conveyed, the feed roller of the corresponding feed unit 6A or 6B may apply conveyance force to it.

(4) In the above embodiment, in the case where the size of the print medium S in the conveyance direction is a predetermined size or larger, the application of conveyance force from the second feed roller 94 to the print medium S is stopped when the leading edge of the print medium S reaches the conveyance roller 7B. However, the present invention is not limited to this. Specifically, the application of conveyance force from the second feed roller 94 to the print medium S may stopped with any timing as long as it is after the leading edge of the print medium S reaches the conveyance roller 7B and before the leading edge comes into abutment with the nip portion N. In this case, the amount of overfeed of the print medium S is managed based on the amount of rotation of the conveyance roller 7B or the like. In short, the second feed roller 94 may be caused to apply conveyance force to the print medium S while the leading edge of the print medium S passes between the conveyance rollers 7A and 7B and between the conveyance roller 7B and the nip portion N, at which the conveyance path is curved.

(5) Though not particularly described in the above embodiment, the printing apparatus 1 may be configured to be capable of receiving information on the type of print medium S and, based on the input type of print medium S, determine whether or not to cause the second feed roller 94 to apply conveyance force to the print medium S. Specifically, in this case, the printing apparatus 1 includes an obtaining unit (second obtaining unit) that obtains information on the type of print medium S. More specifically, the conveyance control unit 207 determines whether or not to cause the second feed roller 94 to apply conveyance force to the print medium S, based on at least one of the type and size of the print medium S. For example, the conveyance control unit 207 does not cause the second feed roller 94 to apply conveyance force to a print medium S whose frictional resistance on the conveyance rollers 7A and 7B is a predetermined value or greater, and causes the second feed roller 94 to apply conveyance force to a print medium whose frictional resistance on the conveyance rollers 7A and 7B is less than the predetermined value.

(6) In the above embodiment, conveyance rollers (conveyance rollers 7A and 7B) are provided between the main conveyance roller 70 and the third feed unit 6C. However, one conveyance roller may be provided or three or more conveyance rollers may be provided. Further, although the conveyance path from the main conveyance roller 70 to the third feed unit 6C is curved, this conveyance path may be designed to be straight.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-24638 filed Feb. 15, 2018, which is hereby incorporated by reference herein in its entirety.

What is claimed is:

1. A conveyance device comprising:

a feed unit that feeds a print medium by rotating a roller in a state in which the roller is in contact with the print medium;

a conveyance unit that conveys the print medium fed from the feed unit to a print unit; and a control unit that determines a method for controlling the feed unit based on a size of the print medium before the print medium is conveyed to the conveyance unit, wherein, in a case in which the size of the print medium is equal to or larger than a predetermined size, after the print medium reaches the conveyance unit, the control unit rotates the roller of the feed unit so as to apply conveyance force to the print medium conveyed by the conveyance unit, and wherein in a case in which the size of the print medium is smaller than the predetermined size, after the print medium reaches the conveyance unit, the control unit stops the rotation of the roller of the feed unit.

2. The conveyance device according to claim 1, wherein the conveying unit includes a first conveyance unit and a second conveyance unit, wherein the first conveyance unit forms a nip portion between a first drive roller and a first driven roller and is capable of conveying the print medium to the print unit by pinching the print medium at the nip portion, and wherein the second conveyance unit conveys the print medium from the feed unit to the first conveyance unit by pinching the print medium between a second drive roller and a second driven roller.

3. The conveyance device according to claim 2, wherein the second conveyance unit includes an upstream roller and a downstream roller along a conveyance direction of the print medium.

4. The conveyance device according to claim 3, wherein in the case in which the size of the print medium is equal to or larger than the predetermined size, after the print medium reaches the downstream roller, the control unit stops the rotation of the roller of the feed unit.

5. The conveyance device according to claim 2, wherein in a case of causing the feed unit to apply the conveyance force to the print medium conveyed by the second conveyance unit, the control unit stops the application of the conveyance force to the print medium before the leading edge of the print medium comes into abutment with the nip portion.

6. The conveyance device according to claim 2, wherein the second conveyance unit corrects skew of the print medium by conveying the print medium with a leading edge thereof in abutment with the nip portion at the first conveyance unit, which is stopped.

7. The conveyance device according to claim 1, further comprising:

an obtaining unit that obtains information on the size of the print medium in a conveyance direction.

8. The conveyance device according to claim 7, wherein the control unit changes the conveyance force to be applied to the print medium in accordance with the information on the size.

9. The conveyance device according to claim 1, further comprising:

an obtaining unit that obtains information on a type of the print medium, wherein the control unit controls the application of the conveyance force to the print medium based on the information on the type of the print medium obtained by the obtaining unit.

10. The conveyance device according to claim 1, wherein in the case in which the size of the print medium is smaller than the predetermined size, after the print medium reaches the conveyance unit, the control unit stops the rotation of the roller of the feed unit even in a state in which the roller of the feed unit is in contact with the print medium.

11. A conveyance device according to claim 1, further comprising:

a tray on which a print medium is to be loaded, wherein the control unit obtains information on the size of the print medium loaded on the tray and determines the method for controlling the feed unit based on the obtained information on the size of the print medium.

12. The conveyance device according to claim 11, wherein the information is a size of the print medium in a width direction, and a size of the print medium in a conveyance direction is obtained based on the information.

13. A conveyance device comprising:

a feed unit that feeds a print medium by rotating a roller in a state in which the roller is in contact with the print medium, wherein the feed unit includes a first feed roller that picks up the print medium, a second feed roller, and a separation roller;

a conveyance unit that conveys the print medium fed from the feed unit to a print unit; and a control unit that determines a method for controlling the feed unit based on a size of the print medium before the print medium is conveyed to the conveyance unit, wherein the second feed roller feeds the print medium picked up by the first feed roller to the conveyance unit, the separation roller can contact the second feed roller, and, in a case in which the first feed roller picks up a plurality of print media, the separation roller separates a top print medium of the plurality of print media, and wherein, in a case in which the size of the print medium is equal to or larger than a predetermined size, after the print medium reaches the conveyance unit, the control unit rotates at least one roller of the feed unit so as to apply conveyance force to the print medium conveyed by the conveyance unit.

14. The conveyance device according to claim 13, wherein the first feed roller is moved away from the print medium while the feed unit is caused to apply the conveyance force to the print medium.

15. The conveyance device according to claim 13, wherein the control unit controls the application of the conveyance force to the print medium based on the number of rotations of the second feed roller.

16. A printing apparatus comprising:

a feed unit that feeds a print medium by rotating a roller in a state in which the roller is in contact with the print medium, wherein the feed unit includes a first feed roller that picks up the print medium, a second feed roller, and a separation roller;

a conveyance unit that conveys the print medium fed from the feed unit;

a print unit that performs printing on the print medium conveyed by the conveyance unit; and a control unit that determines a method for controlling the feed unit based on a size of the print medium before the print medium is conveyed to the conveyance unit, wherein the second feed roller feeds the print medium picked up by the first feed roller to the conveyance unit, the separation roller can contact the second feed roller, and, in a case in which the first feed roller picks up a plurality of print media, the separation roller separates a top print medium of the plurality of print media, and wherein, in a case in which the size of the print medium is equal to or larger than a predetermined size, after the print medium reaches the conveyance unit, the control unit rotates at least one roller of the feed unit so as to apply conveyance force to the print medium conveyed by the conveyance unit.

17. The printing apparatus according to claim 16, wherein the conveying unit includes a first conveyance unit and a second conveyance unit, wherein the first conveyance unit forms a nip portion between a first drive roller and a first driven roller and is capable of conveying the print medium to the print unit by pinching the print medium at the nip portion, and wherein the second conveyance unit conveys the print medium from the feed unit to the first conveyance unit by pinching the print medium between a second drive roller and a second driven roller.

18. The printing apparatus according to claim 16, further comprising:

an obtaining unit that obtains information on the size of the print medium in a conveyance direction.

19. The printing apparatus according to claim 18, wherein the control unit changes the conveyance force to be applied to the print medium in accordance with the information on the size.

20. The printing apparatus according to claim 16, further comprising:

an obtaining unit that obtains information on a type of the print medium, wherein the control unit controls the application of the conveyance force to the print medium based on the information on the type of the print medium obtained by the obtaining unit.

21. The printing apparatus according to claim 16, wherein in a case of causing the feed unit to apply the conveyance force to the print medium conveyed by the conveyance unit, the control unit stops the application of the conveyance force to the print medium before the leading edge of the print medium hits the nip portion.

22. The printing apparatus according to claim 16, wherein in the case in which the size of the print medium is smaller than the predetermined size, after the print medium reaches the conveyance unit, the control unit stops the rotation of the roller of the feed unit even in a state in which the at least one roller of the feed unit is in contact with the print medium.

23. The printing apparatus according to claim 16, wherein the print unit is capable of discharging ink.

24. A printing apparatus comprising:

a feed unit that feeds a print medium by rotating a roller in a state in which the roller is in contact with the print medium;

a conveyance unit that conveys the print medium fed from the feed unit;

a print unit that performs printing on the print medium conveyed by the conveyance unit; and a control unit that determines a method for controlling the feed unit based on a size of the print medium before the print medium is conveyed to the conveyance unit, wherein, in a case in which the size of the print medium is equal to or larger than a predetermined size, after the print medium reaches the conveyance unit, the control unit rotates the roller of the feed unit so as to apply conveyance force to the print medium conveyed by the conveyance unit, and wherein in a case in which the size of the print medium is smaller than the predetermined size, after the print medium reaches the conveyance unit, the control unit stops the rotation of the roller of the feed unit.

* * * * *